US010714291B2

(12) United States Patent
Shimoda et al.

(10) Patent No.: US 10,714,291 B2
(45) Date of Patent: Jul. 14, 2020

(54) RELAY

(71) Applicant: OMRON CORPORATION, Kyoto-shi, Kyoto (JP)

(72) Inventors: Seiki Shimoda, Yamaga (JP); Akira Tsurusaki, Kumamoto (JP)

(73) Assignee: OMRON Corporation, Kyoto-shi (JP)

( * ) Notice: Subject to any disclaimer, the term of this patent is extended or adjusted under 35 U.S.C. 154(b) by 108 days.

(21) Appl. No.: 15/754,772

(22) PCT Filed: Nov. 16, 2016

(86) PCT No.: PCT/JP2016/083974
§ 371 (c)(1),
(2) Date: Feb. 23, 2018

(87) PCT Pub. No.: WO2017/098874
PCT Pub. Date: Jun. 15, 2017

(65) Prior Publication Data

US 2018/0269018 A1 Sep. 20, 2018

(30) Foreign Application Priority Data

Dec. 11, 2015 (JP) ..... 2015-242409

(51) Int. Cl.
*H01H 3/00* (2006.01)
*H01H 51/08* (2006.01)
(Continued)

(52) U.S. Cl.
CPC ..... *H01H 51/08* (2013.01); *H01H 50/56* (2013.01); *H01H 50/64* (2013.01);
(Continued)

(58) Field of Classification Search
CPC ..... H01H 50/18; H01H 50/20; H01H 50/56; H01H 50/58; H01H 50/64; H01H 1/50;
(Continued)

(56) References Cited

U.S. PATENT DOCUMENTS 1,339,922 A * 5/1920 Deutsch ..... H01H 71/68 335/236
1,354,708 A * 10/1920 Whittingham ..... H01H 71/68 318/447
(Continued)

FOREIGN PATENT DOCUMENTS

CN 201766036 U 3/2011
CN 102237207 A 11/2011
(Continued)

OTHER PUBLICATIONS

The Chinese Office Action (CNOA) dated May 17, 2019 in a related Chinese patent application.
(Continued)

*Primary Examiner* — Shawki S Ismail
*Assistant Examiner* — Lisa N Homza
(74) *Attorney, Agent, or Firm* — Metrolex IP Law Group, PLLC

(57) ABSTRACT

The pressing member is configured to move to an off-position and an on-position. When the pressing member is located at the off-position, the first contact and the second contact come into a non-contact state. When the pressing member is located at the on-position, the first contact and the second contact come into a contact state by press of the pressing member against the contact piece. The actuator moves the pressing member from the off-position to the on-position via an overshoot position located beyond the on-position. The contact piece includes a body, and a low rigidity portion having rigidity lower than rigidity of the body. The pressing member presses the low rigidity portion.

14 Claims, 21 Drawing Sheets

(51) Int. Cl.
*H01H 50/56* (2006.01)
*H01H 50/64* (2006.01)
*H01H 50/20* (2006.01)

(52) U.S. Cl.
CPC ..... *H01H 51/084* (2013.01); *H01H 50/20* (2013.01); *H01H 50/642* (2013.01); *H01H 50/643* (2013.01)

(58) Field of Classification Search
CPC .. H01H 1/54; H01H 1/64; H01H 9/38; H01H 2001/545; H01H 51/08
USPC ..... 335/185
See application file for complete search history.

(56) References Cited

U.S. PATENT DOCUMENTS 1,369,934 A * 3/1921 Onstad ..... B44B 7/00 101/27
2,005,195 A * 6/1935 McCabe ..... H01H 29/00 318/285
2,157,844 A * 5/1939 Armstrong ..... H01F 7/1205 335/245
2,654,009 A * 9/1953 Stuellein ..... H01H 71/443 335/29
2,663,774 A * 12/1953 MacNeill ..... H01H 71/443 335/40
2,959,962 A * 11/1960 Epstein ..... G01L 9/007 73/728
3,098,912 A * 7/1963 Sprague ..... H01H 71/1027 335/9
3,234,344 A * 2/1966 Heilman ..... H01H 71/2463 335/62
3,268,043 A * 8/1966 Murdoch ..... F16D 27/112 192/84.961
3,272,934 A * 9/1966 Schwartz ..... H01H 71/1045 200/50.4
3,307,125 A * 2/1967 Schwarzkopf ..... H02K 33/10 335/95
3,344,372 A * 9/1967 Heilman ..... H01H 71/44 335/28
3,363,571 A * 1/1968 Reynolds ..... F04B 43/02 222/642
3,517,357 A * 6/1970 Bakes ..... H01H 71/30 335/63
3,566,320 A * 2/1971 Bakes ..... H01H 71/345 335/174
3,773,992 A * 11/1973 Mune ..... H01H 9/342 218/149
3,788,597 A * 1/1974 Ichioka ..... F16K 31/0668 251/129.08
3,791,408 A * 2/1974 Saitou ..... F16K 17/04 137/529
4,267,539 A * 5/1981 Guinan ..... H01H 71/7463 335/176
4,316,167 A * 2/1982 Koehler ..... H01H 51/2209 335/229
4,515,343 A * 5/1985 Pischinger ..... F01L 1/16 123/90.11
4,540,965 A * 9/1985 Hattori ..... H01H 3/503 335/259
4,683,453 A * 7/1987 Vollmer ..... H01F 7/1607 335/255
5,207,410 A * 5/1993 Wakeman ..... F02M 51/005 251/129.15
5,389,910 A * 2/1995 Abel ..... H01F 7/1615 335/237
5,845,672 A * 12/1998 Reuter ..... B60T 8/3675 137/315.03
6,044,813 A * 4/2000 Bulgatz ..... F01L 9/04 123/90.11
6,049,264 A * 4/2000 Sailer ..... F01L 9/04 335/220
6,084,492 A * 7/2000 Cereda ..... H01F 7/081 335/220
6,092,784 A * 7/2000 Kalfsbeck ..... H01F 7/081 137/625.65
6,125,803 A * 10/2000 Hattori ..... F01L 9/04 123/90.11
6,155,503 A * 12/2000 Benson ..... F02M 51/06 239/585.1
6,157,277 A * 12/2000 Bulgatz ..... F01L 9/04 251/129.15
6,373,361 B1 * 4/2002 Umemoto ..... F01L 9/04 251/129.15
6,373,363 B1 * 4/2002 Spakowski ..... F02M 51/0614 251/129.15
6,414,406 B1 * 7/2002 Ikoma ..... H01F 7/081 310/14
6,420,949 B1 * 7/2002 Umemoto ..... F01L 9/04 335/251
6,677,844 B1 * 1/2004 Gorospe ..... H01F 7/16 335/220
8,136,790 B2 * 3/2012 Hoppe ..... F01L 1/34 251/129.15
8,350,652 B2 * 1/2013 Hoppe ..... F01L 1/3442 310/12.31
9,502,167 B1 * 11/2016 Gieras ..... H01F 7/081
2001/0003277 A1 * 6/2001 Oyama ..... F01L 1/462 123/90.11
2001/0040018 A1 * 11/2001 Bulgatz ..... F01L 9/04 164/109
2002/0057154 A1 * 5/2002 Keck ..... F01L 9/04 335/256
2002/0066176 A1 * 6/2002 Paasch ..... F01L 9/04 29/602.1
2004/0025949 A1 * 2/2004 Wygnaski ..... F16K 31/0682 137/624.18
2004/0257185 A1 * 12/2004 Telep ..... H01F 7/13 335/220
2005/0189021 A1 * 9/2005 Wygnanski ..... F16K 31/0682 137/625.44
2006/0049901 A1 * 3/2006 Bottcher ..... H01F 7/066 335/229
2007/0062591 A1 * 3/2007 Armour ..... F16K 31/0675 137/625.65
2007/0171009 A1 * 7/2007 Bouchard ..... G10B 3/06 335/14
2007/0171016 A1 * 7/2007 Bonjean ..... H01F 7/1615 335/234
2008/0129432 A1 * 6/2008 Buezis ..... F16K 31/0682 335/265
2009/0001302 A1 * 1/2009 Murayama ..... F16K 31/0675 251/65
2010/0186719 A1 * 7/2010 Venkataraghavan ..... F02M 47/027 123/472
2010/0294221 A1 * 11/2010 Talon ..... H01F 7/081 123/90.11
2011/0253918 A1 * 10/2011 Rampen ..... F04B 7/0076 251/65
2011/0285484 A1 * 11/2011 Hoppe ..... H01F 7/081 335/229
2012/0153199 A1 * 6/2012 Nguyen ..... F16K 27/029 251/129.15
2012/0154077 A1 6/2012 Mikl
2012/0268225 A1 * 10/2012 Mahajan ..... H01F 7/13 335/261
2015/0002248 A1 1/2015 Iwamoto
2015/0318135 A1 * 11/2015 Schuster ..... H01H 50/16 335/43
2015/0340144 A1 * 11/2015 Schmitz ..... H01F 5/02 335/262
2016/0020042 A1 1/2016 Stanton et al.
2017/0175919 A1 * 6/2017 Robertson ..... H01F 7/1615
2017/0284556 A1 * 10/2017 Omekanda ..... H01F 7/081

(56) References Cited

U.S. PATENT DOCUMENTS

| | | | | |
|---|---|---|---|---|
| 2018/0233260 | A1* | 8/2018 | Franz | B60K 5/1283 |
| 2019/0121120 | A1* | 4/2019 | Schiepp | F16K 31/0675 |
| 2019/0148045 | A1* | 5/2019 | Tsuzuki | H01F 27/28 335/209 |

FOREIGN PATENT DOCUMENTS

| | | | |
|---|---|---|---|
| CN | 102568937 | A | 7/2012 |
| CN | 202423142 | U | 9/2012 |
| CN | 203013634 | U | 6/2013 |
| CN | 203205353 | U | 9/2013 |
| CN | 204668248 | U | 9/2015 |
| EP | 3089190 | A1 | 11/2016 |
| GB | 2511569 | B | 5/2015 |
| JP | S47-4698 | B1 | 2/1972 |
| JP | S63-18182 | A | 1/1988 |
| JP | S64-31315 | A | 2/1989 |
| JP | H11-273533 | A | 10/1999 |
| JP | 2002-343215 | A | 11/2002 |
| JP | 2012-74138 | A | 4/2012 |
| JP | 2012-129206 | A | 7/2012 |
| JP | 2015-88463 | A | 5/2015 |
| JP | 5741679 | B1 | 7/2015 |
| WO | 2016/039220 | A1 | 2/1917 |
| WO | 2015/098171 | A1 | 7/2015 |
| WO | 2016/039220 | A1 | 3/2016 |

OTHER PUBLICATIONS

An English translation of the International Search Report of PCT/JP2016/083973 dated Feb. 7, 2017.

An English translation of the Written Opinion of PCT/JP2016/083973 dated Feb. 7, 2017.

An English translation of the International Search Report of PCT/JP2016/083974 dated Feb. 7, 2017.

An English translation of the Written Opinion of PCT/JP2016/083974 dated Feb. 7, 2017.

The Indian Office Action dated Nov. 14, 2019 in a related Indian patent application.

The Chinese Office Action (CNOA) dated Oct. 31, 2018 in a counterpart Chinese Patent application.

The Chinese Office Action (CNOA) dated Dec. 10, 2018 in a related Chinese Patent application.

The Indian Office Action dated Nov. 21, 2019 in a counterpart Indian patent application.

* cited by examiner

RELAY

TECHNICAL FIELD

The present invention relates to a relay.

BACKGROUND ART

A relay moves one of contacts toward the other contact to open or close the contacts. For example, a relay disclosed in Patent Document 1 drives a pressing member by using magnetic force of a coil generated when voltage is applied to the coil. The pressing member thus presses a contact piece and moves a movable contact attached to the contact piece to bring the movable contact into contact with a fixed contact.

PRIOR ART DOCUMENT

Patent Document

Patent Document 1: Japanese Patent No. 5741679

SUMMARY OF THE INVENTION

Problems to be Solved by the Invention

The pressing member moves the movable contact by pressing and bending the contact piece. Accordingly, when the contact piece has high rigidity, force for driving the pressing member needs to increase. This may cause a problem that power consumption required by the coil rises. Particularly in case of adoption of such an actuator which moves the pressing member from an off-position to an on-position via an overshoot position located beyond the on-position, further force is required to move the pressing member to the overshoot position when the contact piece has high rigidity. In this case, power consumption by the coil further rises.

Moreover, when a terminal to which the fixed contact is attached has high rigidity similarly to the contact piece, a large bend of the terminal becomes difficult to achieve. In this case, a load applied to the contact piece at the time of movement of the pressing member to the overshoot position increases. The heavy load thus applied may decrease stability of an action of the contact piece.

An object of the present invention is to provide a relay which reduces a rise of energy consumed by an actuator and achieves a stable action of a contact piece even when the actuator is of such a type which moves a pressing member via an overshoot position.

Means for Solving the Problem

A relay according to an aspect of the present invention includes a first contact, a terminal, a second contact, a contact piece, a pressing member, and an actuator. The first contact is attached to the terminal. The second contact is disposed at a position facing the first contact. The second contact is attached to the contact piece. The pressing member is configured to move to an off-position and an on-position. When the pressing member is located at the off-position, the first contact and the second contact come into a non-contact state. When the pressing member is located at the on-position, the first contact and the second contact come into a contact state by press of the pressing member against the contact piece. The actuator moves the pressing member from the off-position to the on-position via an overshoot position located beyond the on-position. The contact piece includes a body, and a low rigidity portion having rigidity lower than rigidity of the body. The pressing member presses the low rigidity portion.

In relay according to the aspect, the low rigidity portion is bendable with small force by press of the pressing member against the low rigidity portion. Accordingly, a rise of energy consumption by the actuator can be reduced. Moreover, even when the terminal has high rigidity, a load applied to the contact piece by movement of the pressing member to the overshoot position can be reduced by a bend of the low rigidity portion. Accordingly, a stable operation of the contact piece can be obtained.

The low rigidity portion may have a thickness smaller than a thickness of the body. In this case, the reduction of the thickness of the low rigidity portion can decrease rigidity of the low rigidity portion.

The contact piece may include a plurality of leaf springs laminated on each other. The low rigidity portion may include the leaf springs fewer in number than the leaf springs included in the body. In this case, the reduction of the number of the leaf springs constituting the low rigidity portion can decrease rigidity of the low rigidity portion.

The low rigidity portion may be located on a leading end side of the contact piece with respect to the second contact. In this case, a large bend of the low rigidity portion is achievable with small force.

The low rigidity portion may have a width smaller than a width of the body. In this case, the reduction of the width of the low rigidity portion can decrease rigidity of the low rigidity portion.

The contact piece may include a slit formed between the low rigidity portion and the body. In this case, the presence of the slit can decrease rigidity of the low rigidity portion.

The low rigidity portion may include a first low rigidity portion and a second low rigidity portion. The first low rigidity portion and the second low rigidity portion may be extended in a lengthwise direction of the contact piece from the body, and disposed away from each other in a widthwise direction of the contact piece. In this case, a load applied to the contact piece can decrease by bends of the first low rigidity portion and the second low rigidity portion.

The body may include a contact attaching portion to which the second contact is attached. The contact attaching portion may be disposed between the first low rigidity portion and the second low rigidity portion. The contact piece may include a first slit and a second slit. The first slit may be formed between the first low rigidity portion and the contact attaching portion, and extended in the lengthwise direction of the contact piece. The second slit may be formed between the second low rigidity portion and the contact attaching portion, and extended in the lengthwise direction of the contact piece. In this case, the presence of the first slit and the second slit can decrease each rigidity of the first low rigidity portion and the second low rigidity portion.

Each of the first slit and the second slit may reach a position on a proximal end side of the contact piece with respect to the second contact. In this case, each rigidity of the first low rigidity portion and the second rigidity portion can further decrease.

The low rigidity portion may further include a junction that joins the first low rigidity portion and the second low rigidity portion. This configuration reduces a twist between the first low rigidity portion and the second low rigidity portion, thereby reducing deviation of a pressing position.

The pressing member may press the junction. Alternatively, the pressing member may press the first low rigidity portion and the second low rigidity portion.

The pressing position formed in the low rigidity portion and pressed by the pressing member may be located on a leading end side of the contact piece with respect to the second contact. In this case, a large bend of the low rigidity portion is achievable with small force.

The actuator may further include a retaining member that latches the pressing member to retain the pressing member at the on-position. In this case, the pressing member can be stably retained at the on-position without being affected by impact or magnetic force from the outside, compared to the case where the pressing member is retained at the on-position by magnetic force.

Effect of the Invention

According to the present invention, a relay can reduce a rise of energy consumed by an actuator and achieve a stable action of a contact piece even when the actuator is of such a type which moves a pressing member via an overshoot position.

MODE FOR CARRYING OUT THE INVENTION

Figure 1:
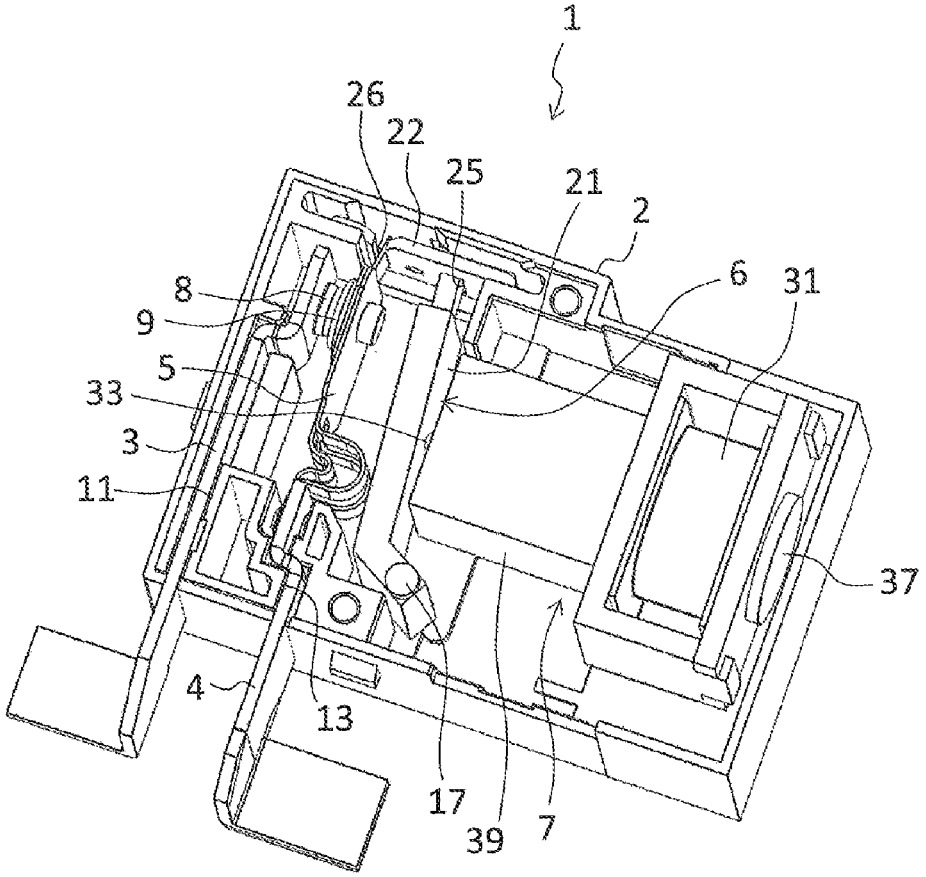
FIG. 1 is a perspective view of a relay according to an embodiment.
Figure 2:
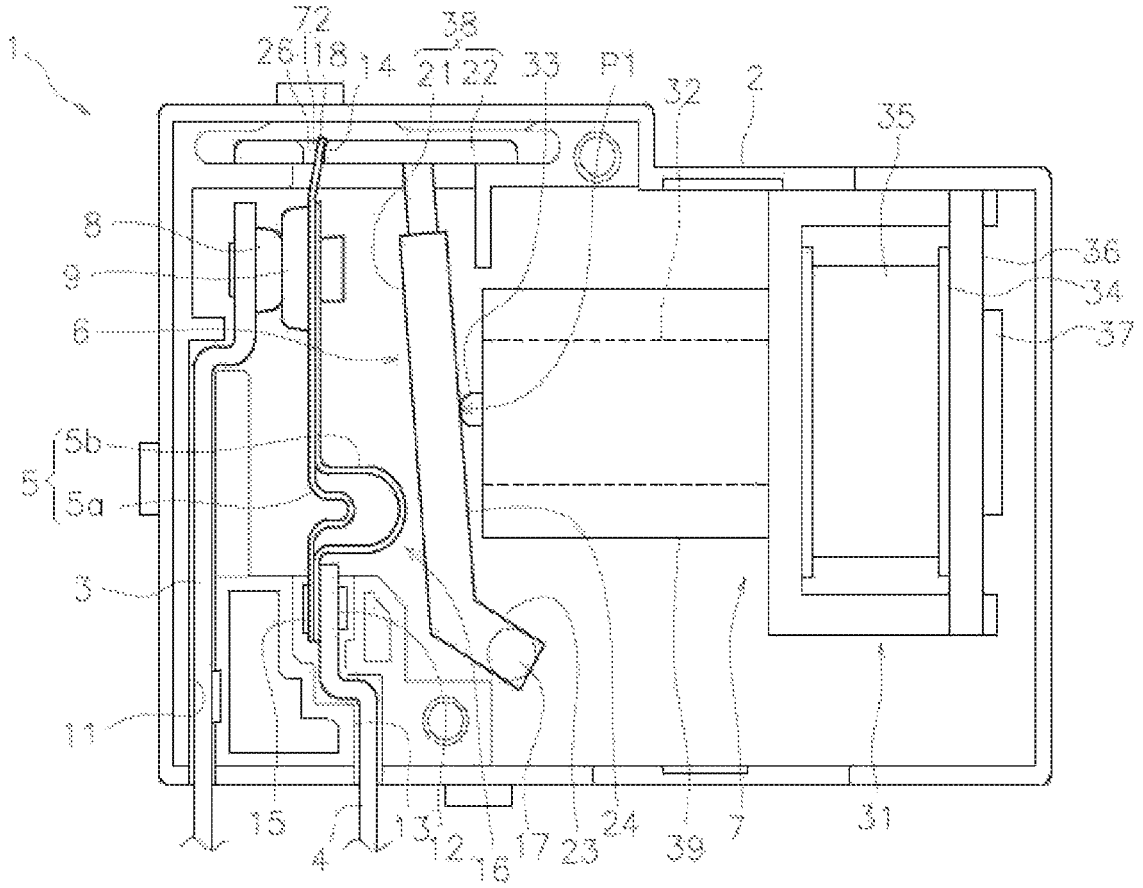
FIG. 2 is a plan view of the relay in a set state.
Figure 3:
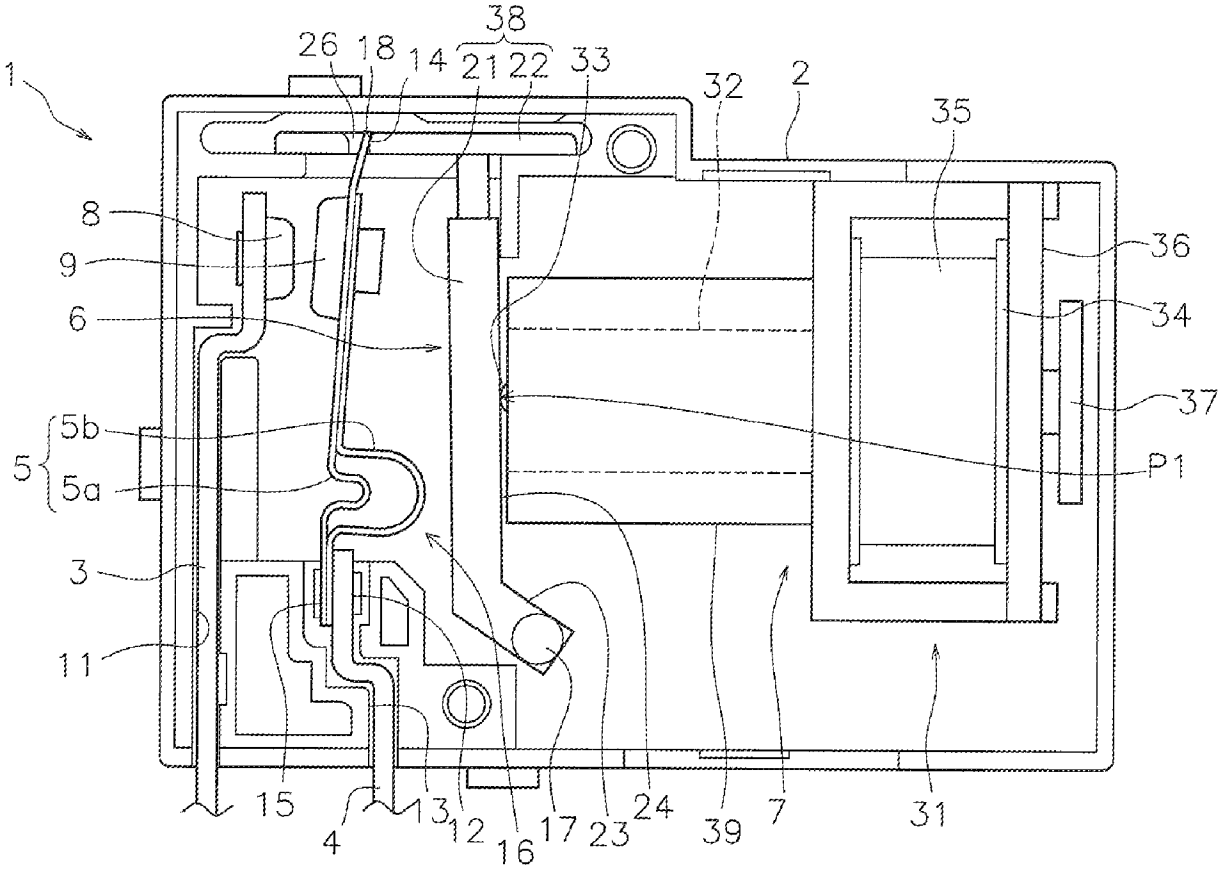
FIG. 3 is a plan view of the relay in a reset state.

A relay according to an embodiment is hereinafter described with reference to the drawings. FIG. 1 is a perspective view of a relay 1 according to the embodiment. FIGS. 2 and 3 are plan views of the relay 1. FIG. 2 illustrates the relay 1 in a set state, while FIG. 3 illustrates the relay 1 in a reset state. The relay 1 according to the embodiment is a latching relay. As illustrated in FIGS. 1 to 3, the relay 1 includes a base 2, a fixed contact terminal 3, a movable contact terminal 4, a contact piece 5, a pressing member 6, and an actuator 7.

The base 2 houses the fixed contact terminal 3, the movable contact terminal 4, the contact piece 5, the pressing member 6, and the actuator 7. The base 2 has an opened face. The opening of the base 2 is covered by a not-shown cover.

The fixed contact terminal 3 is made of a conductive material such as copper. A first contact 8 is attached to one end of the fixed contact terminal 3. The other end of the fixed contact terminal 3 projects from the base 2 toward the outside. A first support groove 11 is formed inside the base 2. The fixed contact terminal 3 is fitted into the first support groove 11 to be supported on the base 2.

The movable contact terminal 4 is made of a conductive material such as copper. As illustrated in FIG. 2, a support 12 is provided at one end of the movable contact terminal 4. The contact piece 5 is attached to the support 12. The other end of the movable contact terminal 4 projects from the base 2 toward the outside. A second support groove 13 is formed inside the base 2. The movable contact terminal 4 is fitted into the second support groove 13 to be supported on the base 2.

The contact piece 5 is made of a conductive material such as copper. The contact piece 5 is disposed at a position facing the fixed contact terminal 3. A leading end portion 14 of the contact piece 5 is pressed by the pressing member 6. A proximal end portion 15 of the contact piece 5 is attached to the support 12 of the movable contact terminal 4. The contact piece 5 is supported on the support 12. A second contact 9 is attached to the contact piece 5. The second contact 9 is disposed at a position facing the first contact 8. The second contact 9 is located between the leading end portion 14 and the support 12.

The contact piece 5 includes a curved portion 16. The curved portion 16 is located between the second contact 9 and the support 12. The second contact 9 is located between the leading end portion 14 and the curved portion 16. The curved portion 16 has a shape expanded in a direction away from the fixed contact terminal 3. The curved portion 16 may have a shape expanded in a direction toward the fixed contact terminal 3. The contact piece 5 includes a plurality of leaf springs 5*a* and 5*b*. The contact piece 5 is constituted by a lamination of the plurality of leaf springs 5*a* and 5*b*.

The second contact 9 is provided to be movable relative to the first contact 8. More specifically, the contact piece 5 is pressed by the pressing member 6 to thereby elastically deform and bend toward the fixed contact terminal 3. The second contact 9 thus moves toward the first contact 8. When the press against the contact piece 5 by the pressing member 6 is released, the contact piece 5 returns in a direction away from the fixed contact terminal 3 by elastic force of the contact piece 5. The second contact 9 thus moves away from the first contact 8. Alternatively, the contact piece 5 may be pulled by the pressing member 6 to move the second contact 9 away from the first contact 8.

Figure 4:
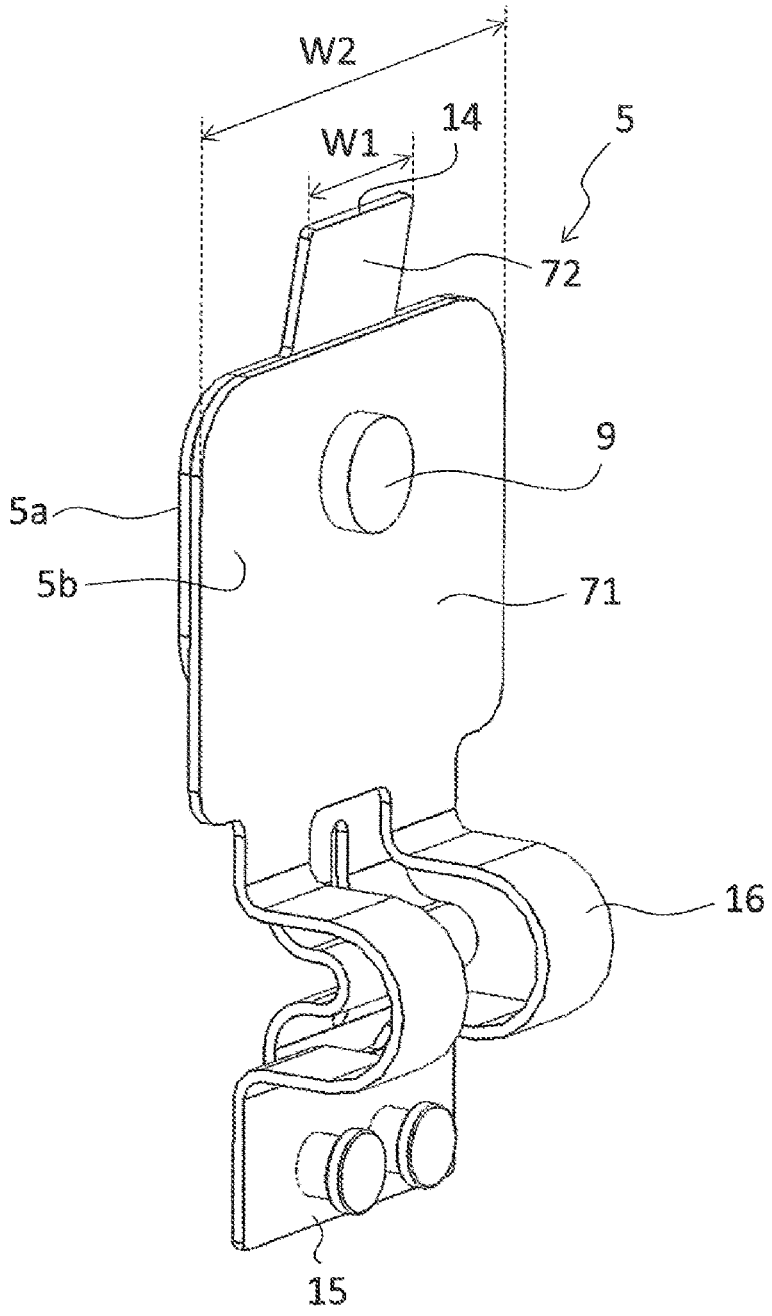
FIG. 4 is a perspective view of a contact piece according to a first embodiment.

FIG. 4 is a perspective view of the contact piece 5 according to a first embodiment. As illustrated in FIG. 4, the contact piece 5 includes a body 71 and a low rigidity portion 72. The second contact 9 is attached to the body 71. The body 71 includes the curved portion 16 and the proximal end portion 15 described above.

The low rigidity portion 72 projects from the body 71 toward the leading end side. The low rigidity portion 72 is located on a leading end side of the contact piece 5 with respect to the second contact 9. The low rigidity portion 72 includes the leading end portion 14 described above. The pressing member 6 therefore presses the low rigidity portion 72. A pressing position formed in the low rigidity portion 72 and pressed by the pressing member 6 is located on the leading end side of the contact piece 5 with respect to the second contact 9.

The low rigidity portion 72 is constituted by the leaf spring 5*a* fewer in number than the leaf springs 5*a* and 5*b* constituting the body 71. Accordingly, the low rigidity portion 72 has a thickness smaller than a thickness of the body 71. Moreover, the low rigidity portion 72 has a width W1 smaller than a width W2 of the body 71. The low rigidity portion 72 therefore exhibits rigidity lower than rigidity of the body 71. Accordingly, when the same pressing force is applied, a displacement amount of the low rigidity portion 72 is larger than a displacement amount of the body 71. In other words, pressing force required by the low rigidity portion 72 is smaller than pressing force required by the body 71 for producing an equivalent displacement amount.

According to the embodiment, the body 71 is constituted by the two leaf springs 5*a* and 5*b*, while the low rigidity portion 72 is constituted by the one leaf spring 5*a*. However, the body 71 may be constituted by more than the two leaf springs 5*a* and 5*b*. The low rigidity portion 72 may be constituted by more than the one leaf spring 5*a*.

As illustrated in FIG. 2, the pressing member 6 includes a first pressing member 33 and a second pressing member 38. The first pressing member 33 moves in the axial direction to press the second pressing member 38. The second pressing member 38 includes a pivot 17 and a contact portion 18. The pivot 17 is rotatably supported on the base 2. The pivot 17 is located on a side where the support 12 is disposed with respect to the curved portion 16. The contact portion 18 is disposed at a position facing the contact piece 5. The second pressing member 38 rotates around the pivot 17 in a direction toward the contact piece 5 to bring the contact portion 18 into contact with the contact piece 5. The contact portion 18 thus presses the leading end portion 14 of the contact piece 5 to move the second contact 9 close to the first contact 8.

The second pressing member 38 includes a first movable portion 21 and a second movable portion 22. The first movable portion 21 and the second movable portion 22 are separate portions. The first movable portion 21 includes the pivot 17. The second movable portion 22 includes the contact portion 18, and extends from the first movable portion 21 toward the contact piece 5.

The first movable portion 21 includes a first part 23 and a second part 24. The first movable portion 21 has a shape bent at a position between the first part 23 and the second part 24. More specifically, the first part 23 obliquely extends from the pivot 17 toward the contact piece 5. The second part 24 is disposed between the contact piece 5 and the actuator 7.

The second movable portion 22 extends from a leading end of the first movable portion 21 toward the leading end portion 14 of the contact piece 5. The second movable portion 22 is connected to the leading end of the first movable portion 21. More specifically, as illustrated in FIG. 1, the second movable portion 22 includes an opening 25. The leading end of the first movable portion 21 is disposed inside the opening 25 of the second movable portion 22.

The second movable portion 22 includes a recess 26. The leading end portion 14 of the contact piece 5 is disposed inside the recess 26. The contact portion 18 described above is a part of an edge of the recess 26. The leading end portion 14 of the contact piece 5 has a shape bent toward the contact portion 18. When the first movable portion 21 rotates around the pivot 17 in a direction of approaching the contact piece 5, the second movable portion 22 is pressed by the leading end of the first movable portion 21. Accordingly, the second movable portion 22 linearly moves in such a direction that the contact portion 18 approaches the contact piece 5.

The actuator 7 moves the first pressing member 33 in the axial direction. The actuator 7 includes a coil 31 and a retaining mechanism 32. The coil 31 includes a bobbin 34, a winding 35, a coil case 36, and an iron core 37. The winding 35 is wound around the bobbin 34. The winding 35 is connected to a not-shown coil terminal. When voltage is applied to the coil 31 via the coil terminal, the coil 31 generates magnetic force which moves the iron core 37 disposed inside the coil 31 in an axial direction of the actuator 7.

The retaining mechanism 32 and the first pressing member 33 are disposed within a housing 39. The retaining mechanism 32 transmits an action of the iron core 37 to the first pressing member 33 to move the first pressing member 33 to an on-position illustrated in FIG. 2 or an off-position illustrated in FIG. 3. The retaining mechanism 32 also mechanically retains the first pressing member 33 at the on-position or the off-position in a state that no voltage is applied to the coil 31. The retaining mechanism 32 will be described in detail below.

The first pressing member 33 moves in the axial direction to press the second pressing member 38. A pressing position P1 at which the first pressing member 33 presses the second pressing member 38 is located between the pivot 17 and the contact portion 18. The pressing position P1 is located on a side where the second contact 9 is disposed with respect to the curved portion 16. The pressing position P1 is located on a side where the curved portion 16 is disposed with respect to the second contact 9.

When the first pressing member 33 is located at the off-position illustrated in FIG. 3, the first contact 8 and the second contact 9 separate from each other. The relay 1 therefore comes into the reset state. When the first pressing member 33 moves to the on-position illustrated in FIG. 2 and presses the second pressing member 38, the contact portion 18 presses the contact piece 5. The contact piece 5 therefore bends toward the movable contact terminal 4. As a result, the first contact 8 and the second contact 9 come into contact with each other, and the relay 1 is in the set state as illustrated in FIG. 2. When the first pressing member 33 returns from the on-position to the off-position as illustrated in FIG. 3, the first contact 8 and the second contact 9 separate from each other. The relay 1 therefore returns to the reset state.

Figure 5:
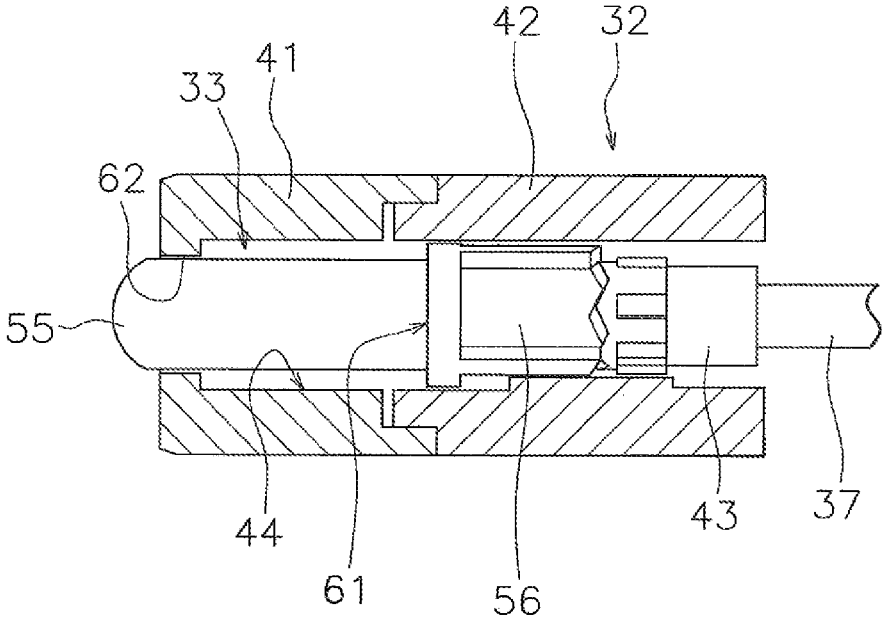
FIG. 5 is a cross-sectional view illustrating a configuration of a retaining mechanism.
Figure 6:
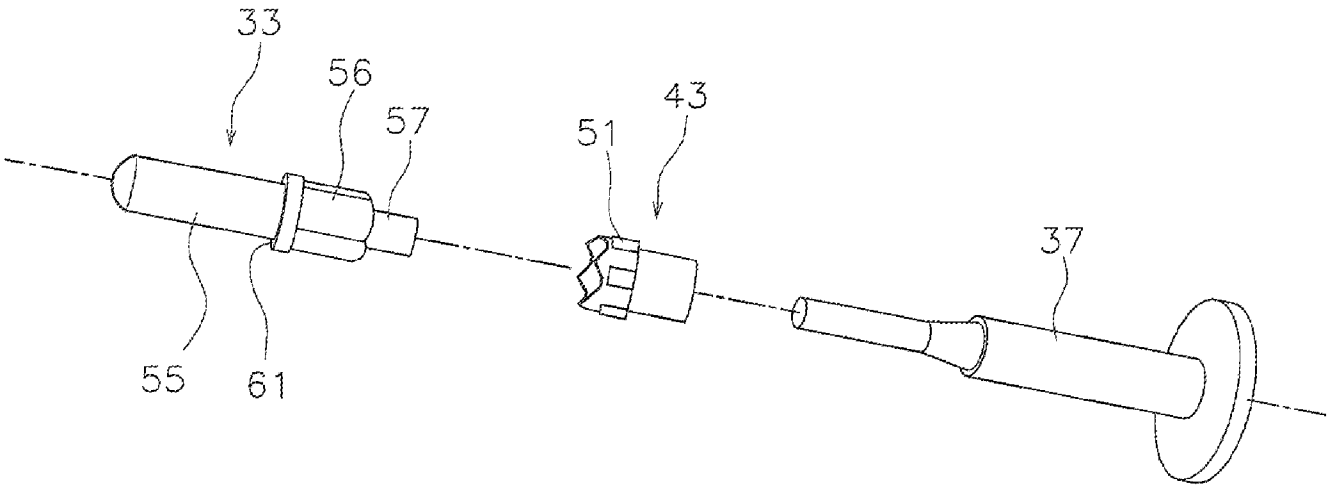
FIG. 6 is an exploded perspective view illustrating a part of the retaining mechanism.

Next, a configuration of the retaining mechanism 32 is described in detail. FIG. 5 is a cross-sectional view illustrating the configuration of the retaining mechanism 32. FIG. 6 is an exploded perspective view illustrating a part of the configuration of the retaining mechanism 32. As illustrated in FIG. 5, the retaining mechanism 32 includes a cover 41, a retaining member 42, and a pusher 43.

The cover 41 is attached to a leading end of the retaining member 42. A through hole 44 is formed inside the cover 41 and the retaining member 42. The first pressing member 33, the pusher 43, and the iron core 37 described above are disposed to be movable in the axial direction within the through hole 44.

Figure 7:
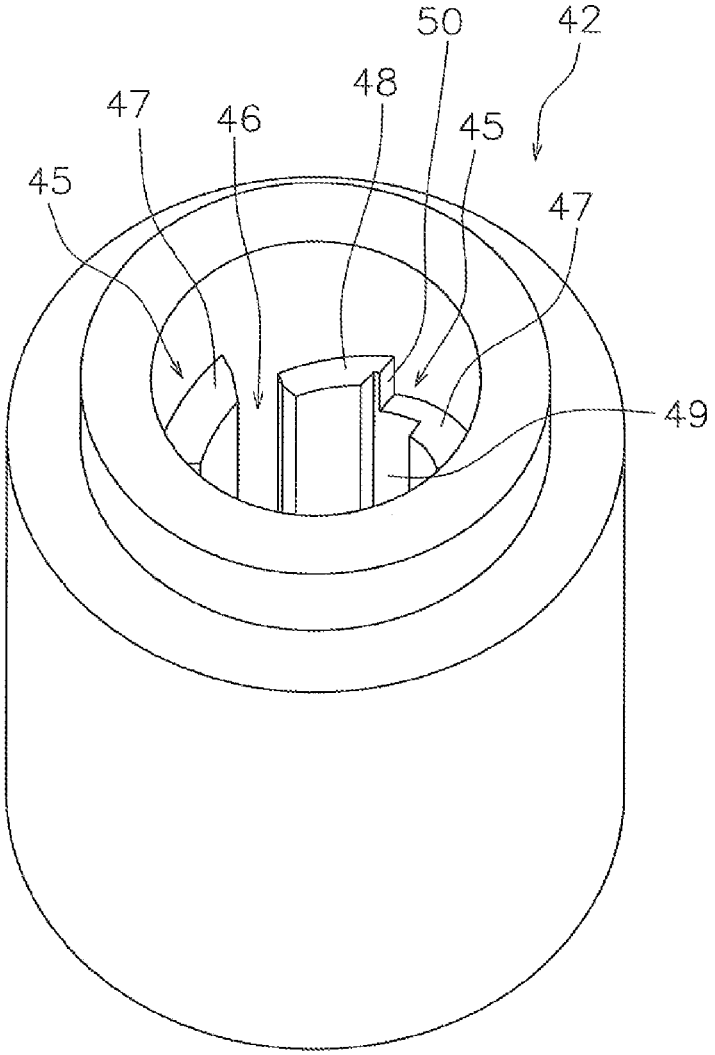
FIG. 7 is a perspective view of a retaining member.
Figure 8:
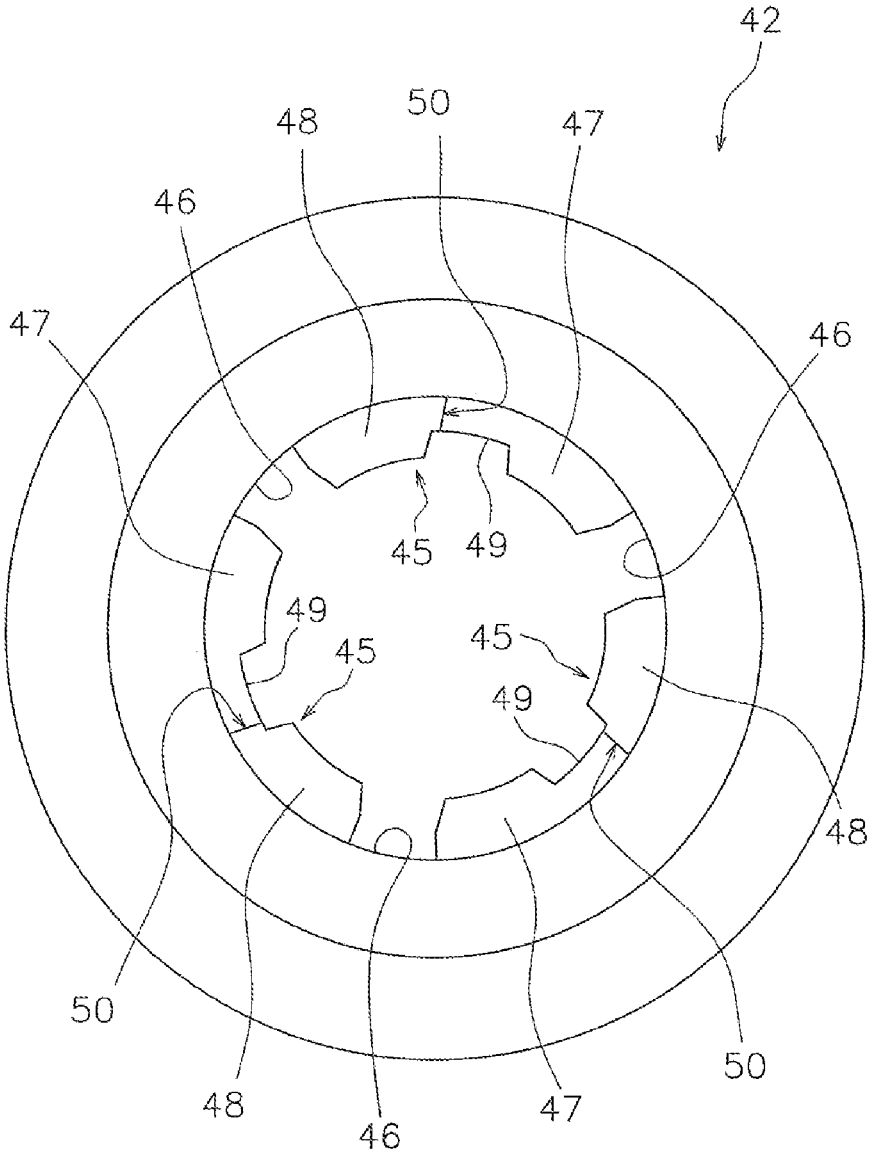
FIG. 8 is a view of the retaining member as viewed in an axial direction.

FIG. 7 is a perspective view of the retaining member 42. FIG. 8 is a view of the retaining member 42 as viewed in the axial direction. As illustrated in FIGS. 7 and 8, the retaining member 42 includes a plurality of retaining projections 45. The retaining projections 45 project from an inner circumferential surface of the retaining member 42. The plurality of retaining projections 45 are disposed with a space left between each other in the circumferential direction of the retaining member 42. A release groove 46 extending in the axial direction is formed in each of the spaces between the plurality of retaining projections 45.

Figure 9:
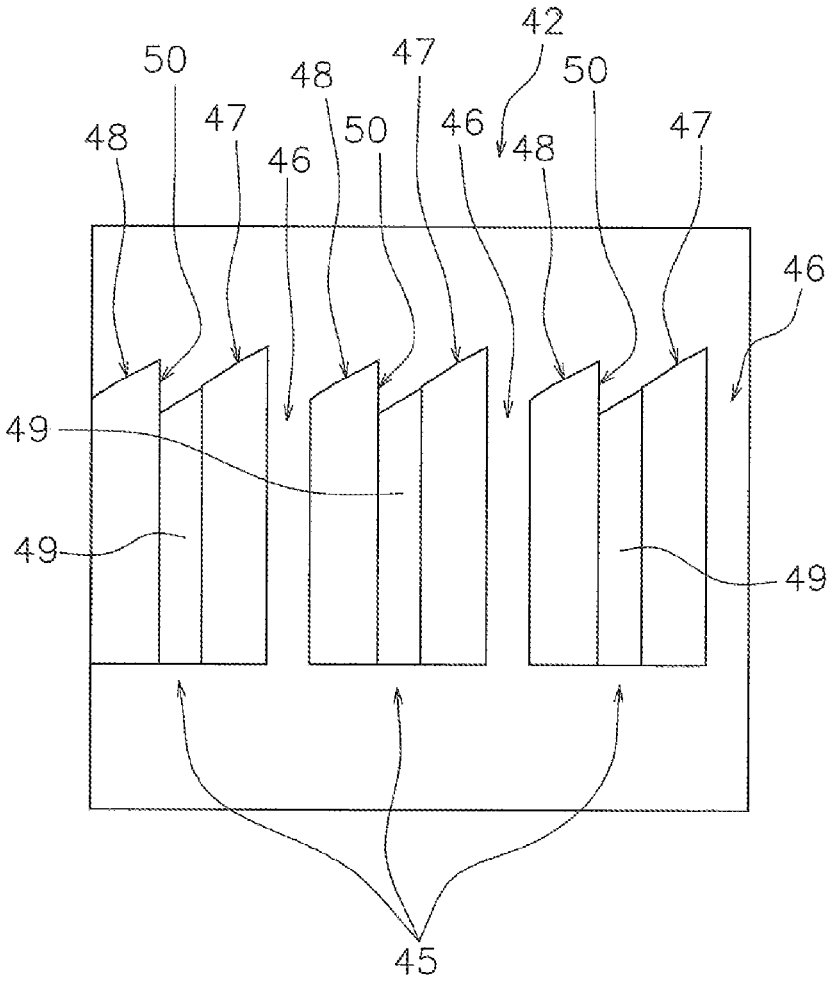
FIG. 9 is a developed view of an inner surface of the retaining member.

FIG. 9 is a view of the inner circumferential surface of the retaining member 42 developed in a plane. As illustrated in FIGS. 8 and 9, each of the retaining projections 45 has a latching inclined surface 47 and a releasing inclined surface 48. A step is formed by the latching inclined surface 47 and the releasing inclined surface 48. Each of the retaining projections 45 includes a guide groove 49 extending in the axial direction.

Figure 10:
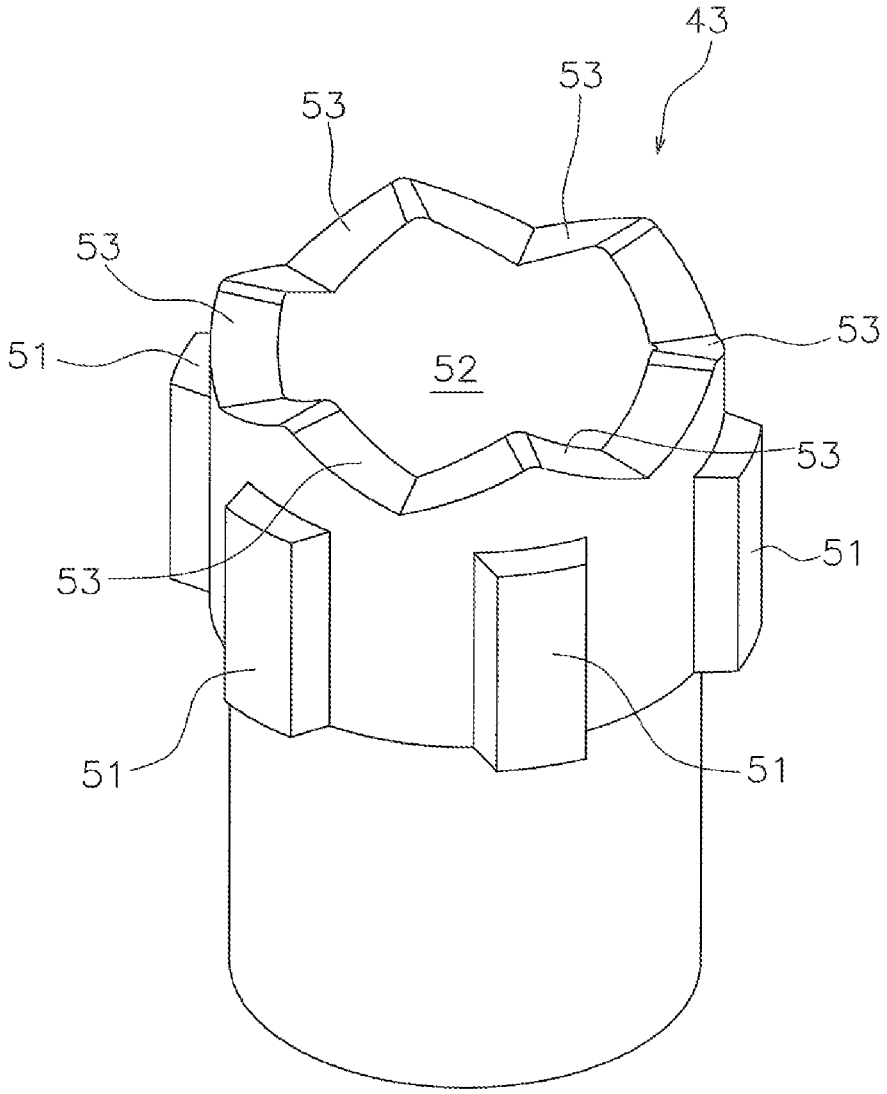
FIG. 10 is a perspective view of a pusher.

FIG. 10 is a perspective view of the pusher 43. As illustrated in FIG. 10, a plurality of guide projections 51 are formed on an outer circumferential surface of the pusher 43. The guide projections 51 are disposed with a space left between each other in the circumferential direction of the pusher 43. Each of the guide projections 51 is disposed in the guide groove 49 and the release groove 46 of the retaining member 42. When the pusher 43 moves in the axial direction, the guide projections 51 move along the guide grooves 49 and the release grooves 46. A bore 52 and a plurality of inclined surfaces 53 are provided at one end of the pusher 43. The plurality of inclined surfaces 53 are disposed around the bore 52. The one end of the pusher 43 is allowed to be pressed by the iron core 37.

Figure 11:
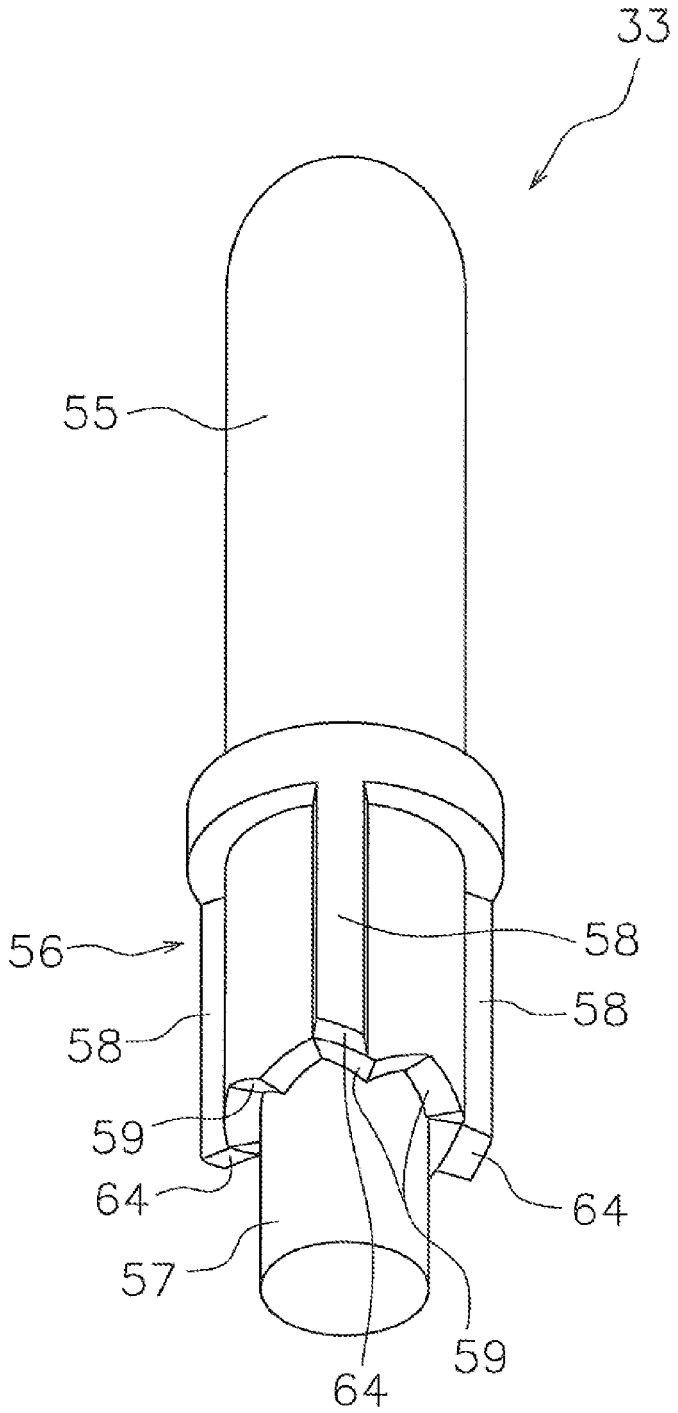
FIG. 11 is a perspective view of a pressing member.

FIG. 11 is a perspective view of the first pressing member 33. As illustrated in FIG. 11, the first pressing member 33 includes a pressing portion 55, a latching portion 56, and a support shaft 57. The pressing portion 55 has a shaft shape. A leading end of the pressing portion 55 has a curved shape. The leading end of the pressing portion 55 comes into contact with the second pressing member 38 when the first pressing member 33 presses the second pressing member 38.

The latching portion 56 has a plurality of latching projections 58. The plurality of latching projections 58 are disposed with a space left between each other in the circumferential direction of the latching portion 56. The plurality of latching projections 58 are movable along the release grooves 46 described above.

Figure 12:
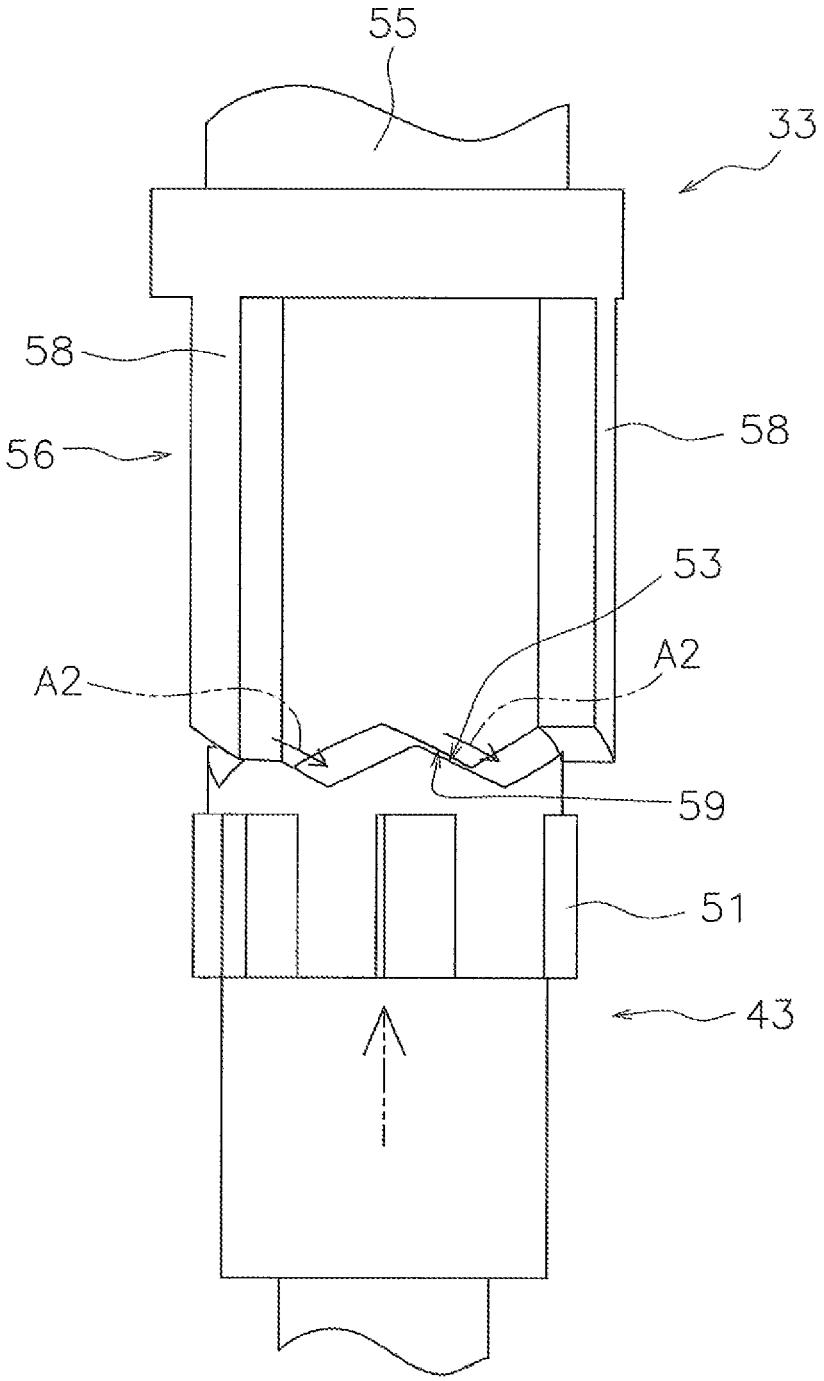
FIG. 12 is an enlarged view illustrating the pressing member and the pusher.

A plurality of inclined surfaces 59 are provided at an end of the latching portion 56. The plurality of inclined surfaces 59 are disposed in the circumferential direction of the latching portion 56. FIG. 12 is a view illustrating the first pressing member 33 and the pusher 43. As illustrated in FIG. 12, the plurality of inclined surfaces 59 of the latching portion 56 are disposed at positions facing the plurality of inclined surfaces 53 of the pusher 43. As illustrated in FIG. 11, the support shaft 57 projects from the latching portion 56. The support shaft 57 is disposed in the bore 52 of the pusher 43. Accordingly, the first pressing member 33 is supported by the pusher 43 in such a manner as to be movable in the axial direction and rotatable around the axis.

As illustrated in FIGS. 5 and 6, a step 61 is formed by the pressing portion 55 and the latching portion 56. A flange 62 is provided on the inner circumferential surface of the cover 41.

Figure 13:
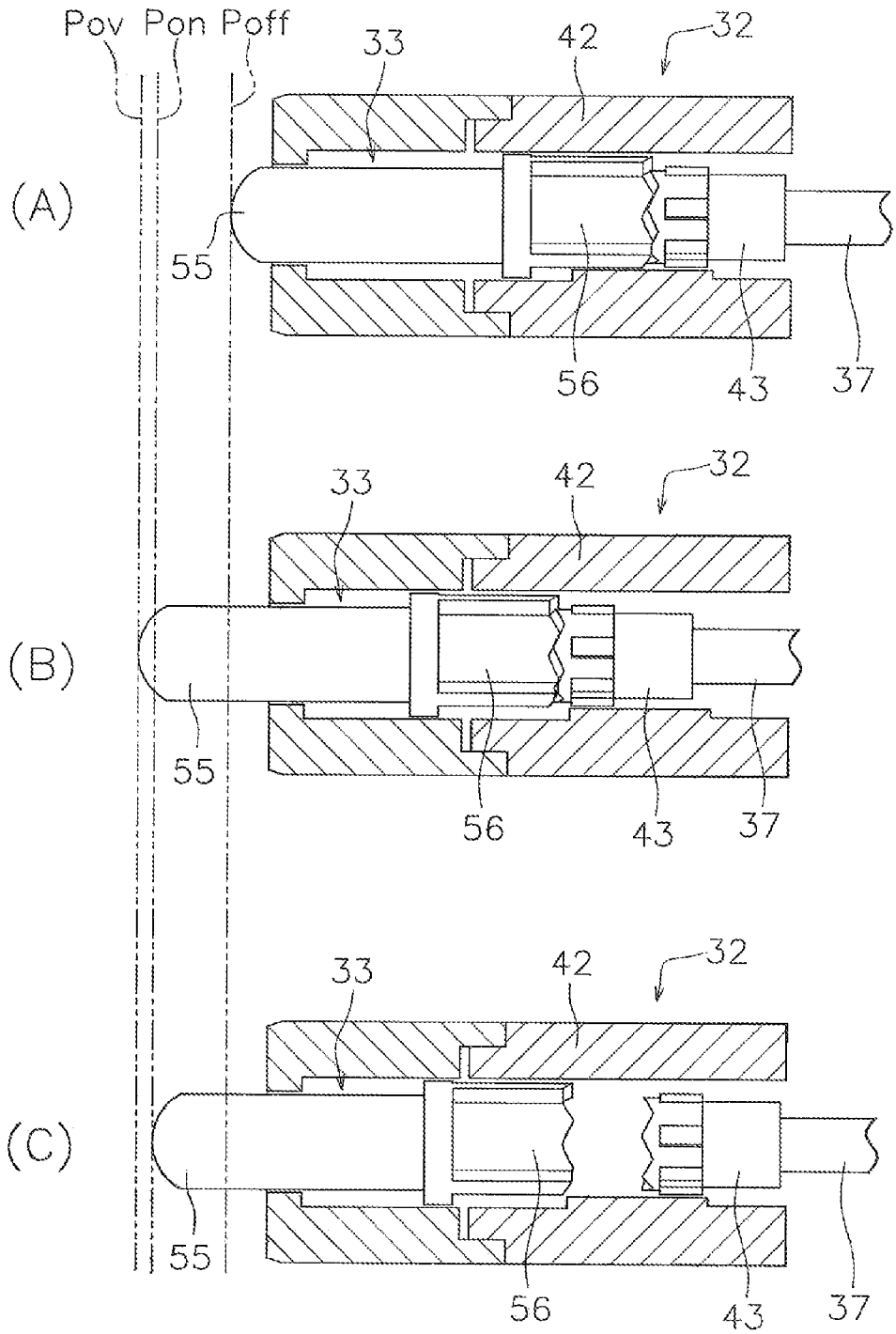
FIG. 13 is a cross-sectional view illustrating operation states of an actuator.

Next, an operation of the actuator 7 is described. FIG. 13 is a cross-sectional view illustrating operation states of the actuator 7. In FIG. 13, the on-position and the off-position of the first pressing member 33 are expressed as "Pon" and "Poff", respectively. Further, an overshoot position of the first pressing member 33 described below is expressed as "Pov". Each of FIGS. 14(A) to 14(C) and FIGS. 15(A) to 15(C) is a view illustrating a relationship between the inner circumferential surface of the retaining member 42 and the latching projections 58 of the first pressing member 33 in a plane.

In the following description, an "off-direction" refers to a direction from the on-position Pon to the off-position Poff. The "off-direction" corresponds to the right direction in FIG. 13, and to the downward direction in FIGS. 14(A) to 14(C) and FIGS. 15(A) to 15(C). An "on-direction" refers to a direction from the off-position Poff to the on-position Pon. The "on-direction" corresponds to the left direction in FIG. 13, and to the upward direction in FIGS. 14(A) to 14(C) and FIGS. 15(A) to 15(C).

Figure 14:
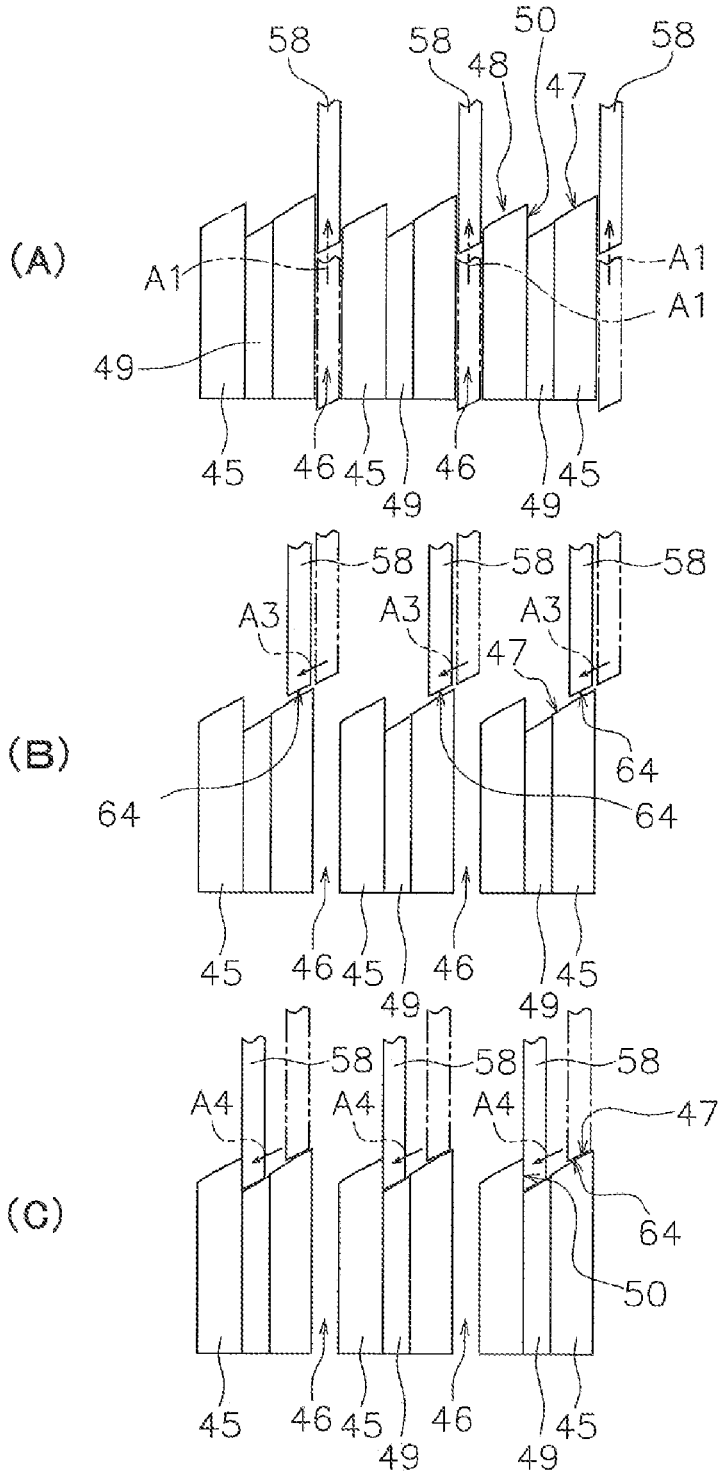
FIGS. 14(A), 14(B), and 14(C) are developed views illustrating operations of an inner circumferential surface of a retaining member and latching projections of a latching member.

In (A) of FIG. 13, the first pressing member 33 is located at the off-position Poff. In this state, the latching projections 58 of the first pressing member 33 are disposed inside the release grooves 46 of the retaining member 42 as indicated by two-dot chain lines in FIG. 14(A). When voltage is applied to the actuator 7, the coil 31 generates electromagnetic force in the iron core 37 in the on-direction. As a result, the iron core 37 moves in the on-direction and presses the pusher 43. The pusher 43 presses the latching portion 56 in the on-direction. Accordingly, the latching projections 58 move in the on-direction along the release grooves 46 (arrows A1) as illustrated in FIG. 14(A).

At this time, the inclined surfaces 53 of the pusher 43 press the inclined surfaces 59 of the latching portion 56 as illustrated in FIG. 12. The latching portion 56 therefore receives force for rotating the latching portion 56 (arrows A2). Accordingly, when the latching projections 58 reach positions beyond the retaining projections 45, the latching projections 58 move to positions facing the latching inclined surfaces 47 (arrows A3) in accordance with rotation of the latching portion 56 as illustrated in FIG. 14(B).

In the state that the latching projections 58 are located beyond the retaining projections 45, the first pressing member 33 reaches the overshoot position Pov after further movement in the on-direction from the on-position Pon as illustrated in (B) of FIG. 13.

When voltage applied to the actuator 7 stops, the first pressing member 33 moves in the off-direction by the elastic force of the contact piece 5. Accordingly, the latching projections 58 move in the off-direction and contact the latching inclined surfaces 47 as illustrated in FIG. 14(C). Each end of the latching projections 58 has an inclined surface 64 inclined in the same direction as the inclination direction of the latching inclined surfaces 47. The latching portion 56 is therefore pressed further in the off-direction, so that the respective inclined surfaces 64 of the latching projections 58 slide along the latching inclined surfaces 47 (arrows A4). Thereafter, the latching projections 58 come to a stop when latched by the latching inclined surfaces 47 and the steps 50.

In this state, the first pressing member 33 is located at the on-position Pon illustrated in (C) of FIG. 13. In the latched state of the latching portion 56 by the retaining member 42, the first pressing member 33 does not move in the off-direction even when the pusher 43 and the iron core 37 return in the off-direction as illustrated in (C) of FIG. 13. Accordingly, the first pressing member 33 is retained at the on-position Pon while resisting the elastic force of the contact piece 5.

Each of the latching projections 58 moving to a position facing the guide groove 49 has a larger outside diameter than the inside diameter of the guide groove 49. Thus, each of the latching projections 58 does not enter the guide groove 49, but stops by latching of the retaining projection 45. This latching regulates the movement of the latching projection 58 in the off-direction.

Figure 15:
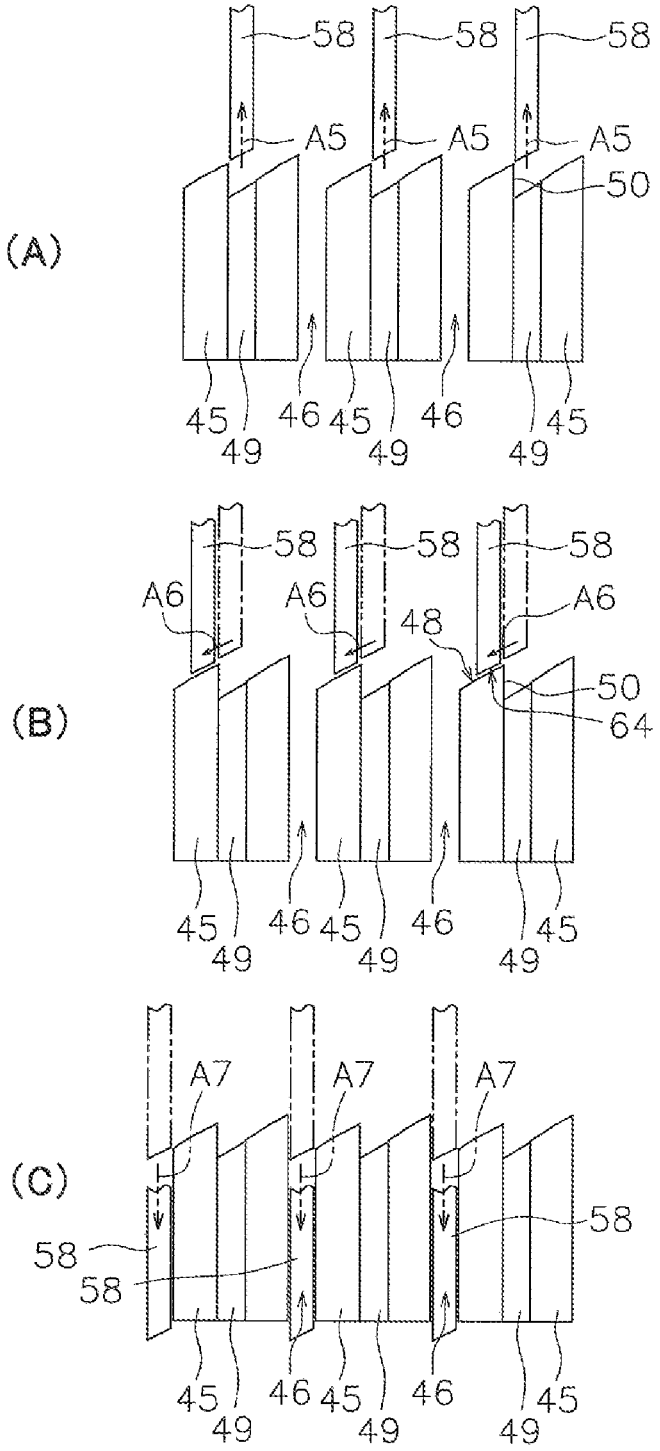
FIGS. 15(A), 15(B), and 15(C) are developed views illustrating operations of the inner circumferential surface of the retaining member and the latching projections of the latching member.

When voltage is subsequently applied to the actuator 7 in the state that the first pressing member 33 is located at the on-position Pon as illustrated in (C) of FIG. 13, the coil 31 generates electromagnetic force in the iron core 37 in the on-direction. Accordingly, the iron core 37 moves in the on-direction, and the pusher 43 presses the first pressing member 33 in the on-direction from the on-position Pon while resisting the elastic force of the contact piece 5. As a result, the latching projections 58 move in the on-direction (arrows A5) as illustrated in FIG. 15(A).

When the latching projections 58 reach positions above the steps 50 of the retaining member 42, the latching portion 56 rotates around the axis in the same manner as described above. As a result, the latching projections 58 move to positions facing the releasing inclined surfaces 48 (arrows A6) as illustrated in FIG. 15(B). At this time, the first pressing member 33 is located at the overshoot position Pov illustrated in (C) of FIG. 13.

When voltage applied to the actuator 7 then stops, the first pressing member 33 moves in the off-direction by the elastic force of the contact piece 5. The inclined surfaces 53 of the latching projections 58 therefore slide along the releasing inclined surfaces 48, and move to positions facing the release grooves 46 as illustrated in FIG. 15(C). Subsequently, the latching projections 58 move in the off-direction along the release grooves 46. Accordingly, the latching portion 56 moves in the off-direction, whereby the first pressing member 33 returns to the off-position Poff.

As described above, the actuator 7 moves the first pressing member 33 from the off-position Poff to the on-position Pon via the overshoot position Pov. The actuator 7 also moves the first pressing member 33 from the on-position Pon to the off-position Poff via the overshoot position Pov. Retention and release of the first pressing member 33 by using the retaining member 42 are switchable by passage of the first pressing member 33 through the overshoot position Pov.

The relay 1 according to the embodiment has the following characteristics.

The low rigidity portion 72 is bendable with small force by press of the pressing member 6 against the low rigidity portion 72. Accordingly, a rise of energy consumed by the actuator 7 can be reduced. Moreover, the thickness of the body 71 is made larger than the thickness of the low rigidity portion 72. Accordingly, conductivity of the contact piece 5 can be increased, which can reduce an excessive temperature rise during conduction.

According to the embodiment, the thickness of the fixed contact terminal 3 is larger than the thickness of the body 71. Accordingly, the fixed contact terminal 3 has rigidity higher than rigidity of the body 71. However, even in the state of high rigidity of the fixed contact terminal 3, a load applied to the contact piece 5 by movement of the first pressing member 33 to the overshoot position Pov is reducible by a bend of the low rigidity portion 72. Accordingly, a stable operation of the contact piece 5 is realizable.

The first pressing member 33 is retained at the on-position Pon by latching of the latching portion 56 by the retaining member 42. In other words, the first pressing member 33 is retained at the on-position Pon not by magnetic force but in a mechanical manner. Accordingly, the relay 1 can be maintained in the set state even at a stop of voltage applied to the coil 31. Moreover, when voltage is applied to the coil 31 to cancel the set state, the pusher 43 rotates and retains the first pressing member 33 at the off-position Poff. Accordingly, the relay 1 can be maintained in the reset state even at a stop of voltage applied to the coil 31.

In the relay 1 according to the embodiment, the state of the relay 1 switches between the set state and the reset state for every input of a pulse signal to the actuator 7. If no signal is input, the state of the relay 1 is maintained without change in the state. In this case, the state of the relay 1 can be maintained without the need of continuous application of voltage to the actuator 7. Accordingly, power consumption of the relay 1 can be reduced. Moreover, control by the pulse signal as adopted herein can simplify the configuration of a control circuit included in the actuator 7.

Because the relay 1 is maintained in the set state by the latching between the retaining member 42 and the latching portion 56, impact resistance can be improved as compared to the case that the relay 1 is maintained in the set state by electromagnetic force generated by the coil 31. Furthermore, the set state can be continued without being affected by magnetism from the outside.

Figure 16:
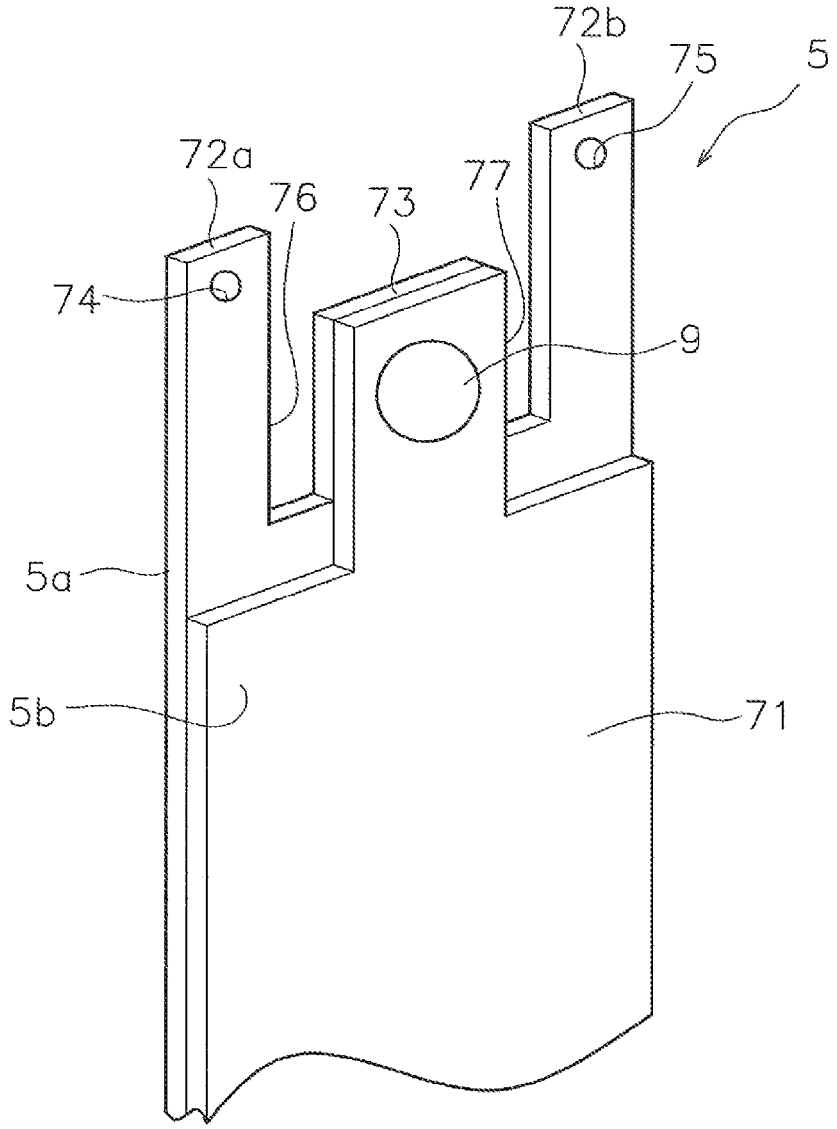
FIG. 16 is a view illustrating a contact piece according to a second embodiment.

Next, the contact piece 5 according to a second embodiment is described. FIG. 16 is a perspective view of the contact piece 5 according to the second embodiment. As illustrated in FIG. 16, the contact piece 5 according to the second embodiment includes the body 71, a first low rigidity portion 72*a*, and a second low rigidity portion 72*b*. The body 71 includes a contact attaching portion 73. The second contact 9 is attached to the contact attaching portion 73. The contact attaching portion 73 is disposed between the first low rigidity portion 72*a* and the second low rigidity portion 72*b*.

The first low rigidity portion 72*a* and the second low rigidity portion 72*b* are extended in the lengthwise direction of the contact piece 5 from the body 71, and disposed away from each other in the widthwise direction of the contact piece 5. The first low rigidity portion 72*a* includes a first hole 74. The second low rigidity portion 72*b* includes a second hole 75. Positions of the first hole 74 and the second hole 75 in the lengthwise direction of the contact piece 5 are located on a leading end side with respect to the second contact 9.

The first low rigidity portion 72*a* has a thickness smaller than the thickness of the body 71. The second low rigidity portion 72*b* has a thickness smaller than the thickness of the body 71. The first low rigidity portion 72*a* is constituted by the leaf spring 5*a* fewer in number than the leaf springs 5*a* and 5*b* constituting the body 71. The second low rigidity portion 72*b* is constituted by the leaf spring 5*a* fewer in number than the leaf springs 5*a* and 5*b* constituting the body 71. According to the embodiment, each of the low rigidity portion 72*a* and the second low rigidity portion 72*b* is constituted by the one leaf spring, while the body 71 is constituted by the two leaf springs 5*a* and 5*b*. However, each of the first low rigidity portion 72*a* and the second low rigidity portion 72*b* may be constituted by more than one leaf spring. The body 71 may be constituted by more than the two leaf springs 5*a* and 5*b*.

The contact piece 5 includes a first slit 76 and a second slit 77. The first slit 76 is formed between the first low rigidity portion 72*a* and the contact attaching portion 73, and extended in the lengthwise direction of the contact piece 5. The second slit 77 is formed between the second low rigidity portion 72*b* and the contact attaching portion 73, and extended in the lengthwise direction of the contact piece 5. The first slit 76 and the second slit 77 reach the proximal end side of the contact piece 5 with respect to the second contact 9.

As apparent from above, each of the first low rigidity portion 72*a* and the second low rigidity portion 72*b* of the contact piece 5 according to the second embodiment has a reduced thickness, and includes the slit 76 or 77. Accordingly, each of the first low rigidity portion 72*a* and the second low rigidity portion 72*b* has rigidity lower than rigidity of the body 71.

Figure 17:
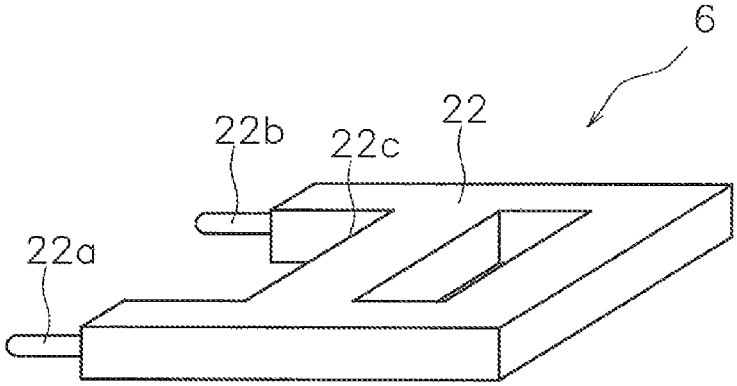
FIG. 17 is a view illustrating a pressing member according to the second embodiment.

FIG. 17 is a perspective view illustrating a part of the pressing member 6 (second movable portion 22) according to the second embodiment. As illustrated in FIG. 17, the pressing member 6 includes a first projection 22*a* and a second projection 22*b*. The first projection 22*a* and the second projection 22*b* are disposed away from each other in the widthwise direction of the contact piece 5. A leading end of the first projection 22*a* is inserted into the first hole 74 of the first low rigidity portion 72*a*. A leading end of the second projection 22*b* is inserted into the second hole 75 of the second low rigidity portion 72*b*. A recess 22*c* is formed between the first projection 22*a* and the second projection 22*b*.

Figure 18:
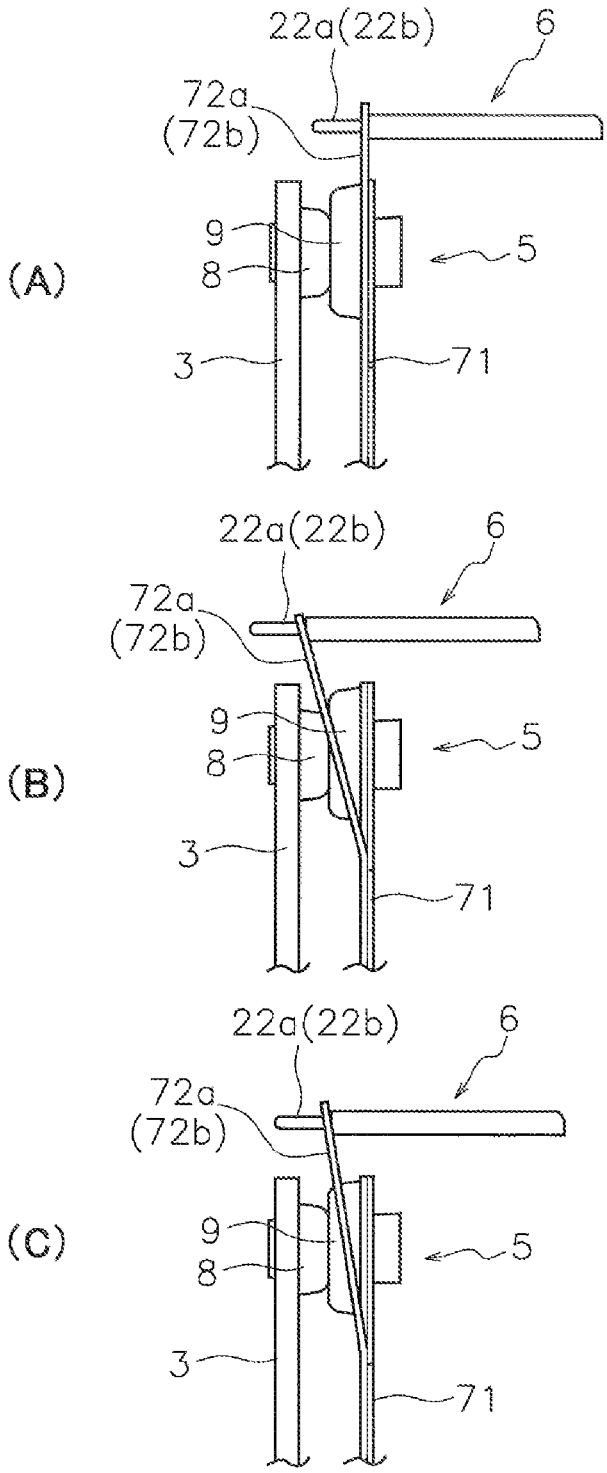
FIGS. 18(A), 18(B), and 18(C) are views illustrating an action of the contact piece according to the second embodiment.

FIGS. 18(A) to 18(C) are views each illustrating an action of the contact piece 5 according to the second embodiment. When the first pressing member 33 described above moves from the off-position Poff to the on-position Pon (see FIG. 13), the first low rigidity portion 72*a* and the second low rigidity portion 72*b* pressed by the first projection 22*a* and the second projection 22*b*, respectively, bring the second contact 9 into contact with the first contact 8 as illustrated in FIG. 18(A). When the first pressing member 33 passes through the on-position Pon and reaches the overshoot position Pov, the first low rigidity portion 72*a* and the second low rigidity portion 72*b* are bent by further movement of the pressing member 6 as illustrated in FIG. 18(B). When the first pressing member 33 subsequently returns to the on-position Pon, a part of the bends of the first low rigidity portion 72*a* and the second low rigidity portion 72*b* returns to the original state as illustrated in FIG. 18(C). In this condition, contact between the second contact 9 and the first contact 8 is retained.

In the contact piece 5 according to the second embodiment described above, the first low rigidity portion 72*a* and the second low rigidity portion 72*b* are similarly bendable with small force by press of the pressing member 6 against the first low rigidity portion 72*a* and the second low rigidity portion 72*b*. Accordingly, a rise of energy consumed by the actuator 7 can be reduced. Moreover, a load applied to the contact piece 5 by movement of the first pressing member 33 to the overshoot position Pov is reducible by bends of the first low rigidity portion 72*a* and the second low rigidity portion 72*b*. Accordingly, a stable operation of the contact piece 5 is realizable.

The present invention is not limited to the embodiment described herein as a specific embodiment of the present invention. Various modifications may be made without departing from the scope of the subject matters of the invention.

The configuration of the relay 1 may be modified. For example, not a single but two or more contacts may be provided to constitute each of the first contact 8 and the second contact 9. The configuration of the contact piece 5 may be modified from the configuration described above in the embodiment.

The shape of the pressing member 6 may be modified from the shape described above in the embodiments. For example, the first movable portion 21 and the second movable portion 22 may be integrated into one piece. Alternatively, the second pressing member 38 may be eliminated. In this case, the contact piece 5 may be pressed directly by the first pressing member 33.

The configuration of the actuator 7 may be modified from the configuration described above in the embodiment. Similarly, the configuration of the retaining mechanism 32 may be modified.

Figure 19:
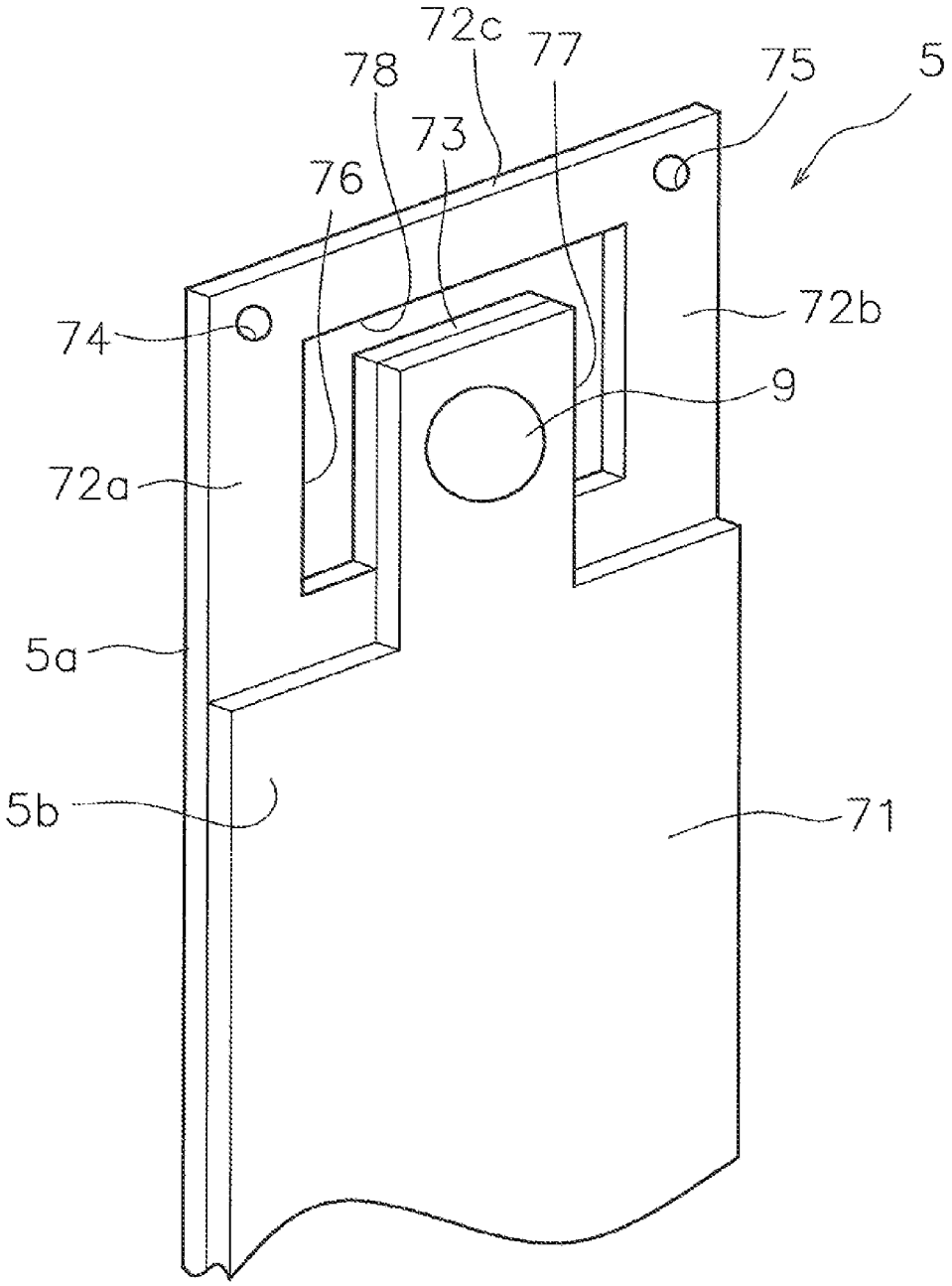
FIG. 19 is a view illustrating a contact piece according to a first modified example.

The shape of the contact piece 5 may be modified from the shape described above in the embodiments. FIG. 19 is a perspective view illustrating the contact piece 5 according to a first modified example. As illustrated in FIG. 19, the contact piece 5 may include a junction 72*c* which joins the first low rigidity portion 72*a* and the second low rigidity portion 72*b*. The first slit 76 and the second slit 77 may be joined with each other via a third slit 78. The third slit 78 is formed between the junction 72*c* and the contact attaching portion 73, and extended in the widthwise direction of the contact piece 5.

The junction 72*c* thus provided reduces a twist between the first low rigidity portion 72*a* and the second low rigidity portion 72*b*. Accordingly, reduction of deviation of the pressing position is achievable. The pressing member 6 of the contact piece 5 according to the first modified example may press the first low rigidity portion 72*a* and the second low rigidity portion 72*b*. Alternatively, the pressing member 6 may press the junction 72*c*.

Figure 20:
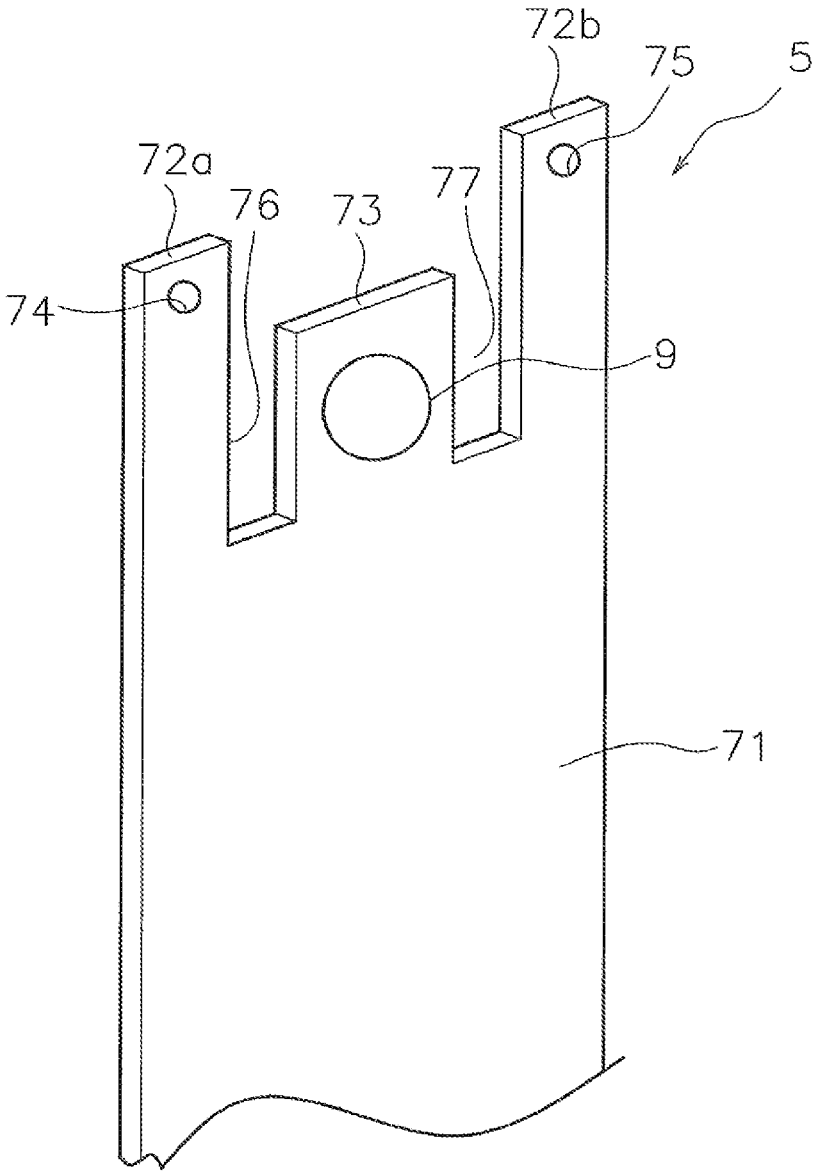
FIG. 20 is a view illustrating a contact piece according to a second modified example.

FIG. 20 is a perspective view illustrating the contact piece 5 according to a second modified example. As illustrated in FIG. 20, each thickness of the low rigidity portions 72*a* and 72*b* may be equal to the thickness of the body 71.

Figure 21:
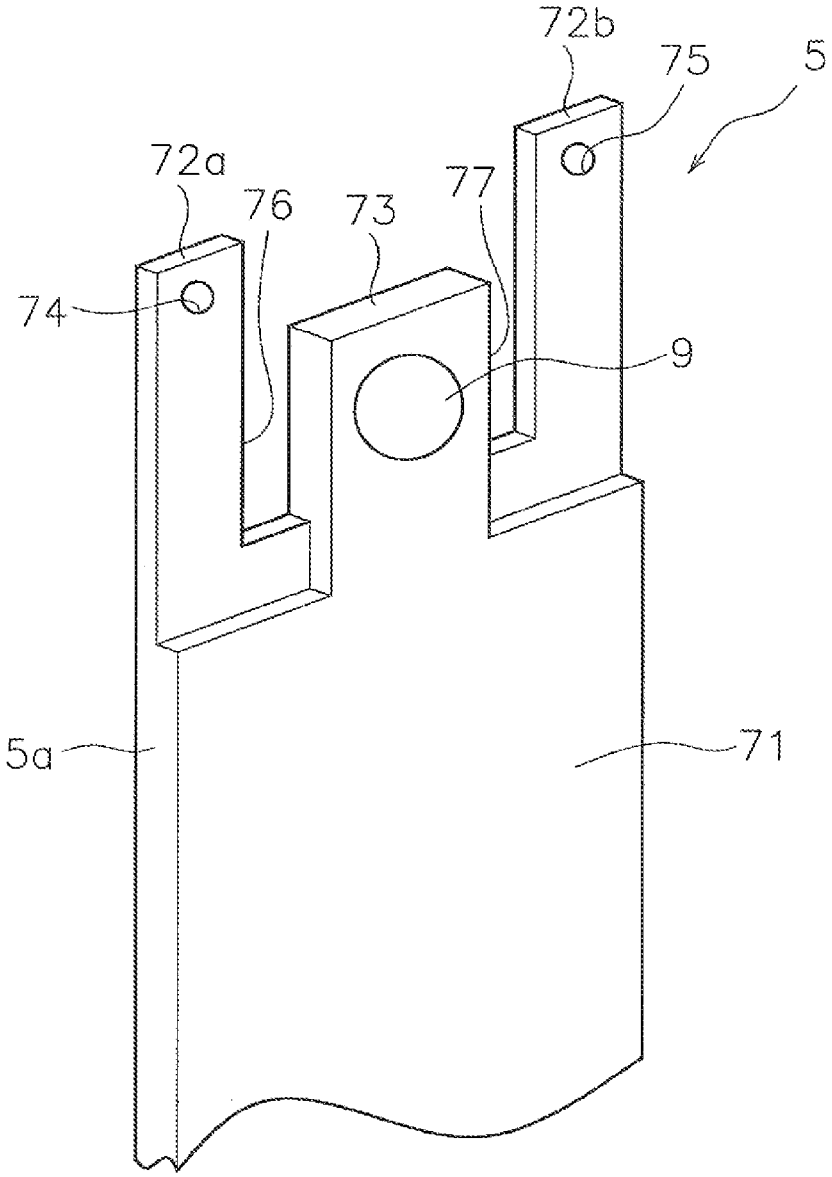
FIG. 21 is a view illustrating a contact piece according to a third modified example.

FIG. 21 is a perspective view illustrating the contact piece 5 according to a third modified example. As illustrated in FIG. 21, each of the low rigidity portions 72*a* and 72*b* of the contact piece 5 constituted by the one leaf spring 5*a* may be made smaller than the thickness of the body 71.

INDUSTRIAL APPLICABILITY

According to the present invention, a relay can reduce a rise of energy consumed by an actuator and achieve a stable action of a contact piece even when the actuator is of such a type which moves a pressing member via an overshoot position.

DESCRIPTION OF SYMBOLS

8 first contact
3 fixed contact terminal
9 second contact
5 contact piece
6 pressing member
7 actuator
71 body
72 low rigidity portion

5*a*, 5*b* leaf spring
72*a* first low rigidity portion
72*b* second low rigidity portion
73 contact attaching portion
76 first slit
77 second slit
72*c* junction
42 retaining member

The invention claimed is:

1. A relay comprising:

a first contact;

a terminal to which the first contact is attached;

a second contact disposed at a position facing the first contact;

a contact piece to which the second contact is attached;

a pressing member configured to move to an off-position at which the first contact and the second contact come into a non-contact state, and an on-position at which the first contact and the second contact come into a contact state by press of the pressing member against the contact piece; and an actuator configured to move the pressing member from the off-position to the on-position via an overshoot position located beyond the on-position, wherein the contact piece includes a body and a low rigidity portion having rigidity lower than rigidity of the body, and the pressing member presses the low rigidity portion.

2. The relay according to claim 1, wherein the low rigidity portion has a thickness smaller than a thickness of the body.

3. The relay according to claim 1, wherein the contact piece includes a plurality of leaf springs laminated on each other, and the low rigidity portion includes the leaf springs fewer in number than the leaf springs included in the body.

4. The relay according to claim 1, wherein the low rigidity portion is located on a leading end side of the contact piece with respect to the second contact.

5. The relay according to claim 1, wherein the low rigidity portion has a width smaller than a width of the body.

6. The relay according to claim 1, wherein the contact piece includes a slit formed between the low rigidity portion and the body.

7. The relay according to claim 1, wherein the low rigidity portion includes a first low rigidity portion and a second low rigidity portion, and the first low rigidity portion and the second low rigidity portion are extended in a lengthwise direction of the contact piece from the body, and disposed away from each other in a widthwise direction of the contact piece.

8. The relay according to claim 7, wherein the body includes a contact attaching portion disposed between the first low rigidity portion and the second low rigidity portion, the second contact being attached to the contact attaching portion, and the contact piece includes a first slit formed between the first low rigidity portion and the contact attaching portion, and extended in the lengthwise direction of the contact piece, and a second slit formed between the second low rigidity portion and the contact attaching portion, and extended in the lengthwise direction of the contact piece.

9. The relay according to claim 8, wherein each of the first slit and the second slit reaches a position on a proximal end side of the contact piece with respect to the second contact.

10. The relay according to claim 7, wherein the low rigidity portion further includes a junction configured to join the first low rigidity portion and the second low rigidity portion.

11. The relay according to claim 10, wherein the pressing member presses the junction.

12. The relay according to claim 7, wherein the pressing member presses the first low rigidity portion and the second low rigidity portion.

13. The relay according to claim 1, wherein a pressing position formed in the low rigidity portion and pressed by the pressing member is located on a leading end side of the contact piece with respect to the second contact.

14. The relay according to claim 1, wherein the actuator includes a retaining member configured to latch the pressing member to retain the pressing member at the on-position.

* * * * *